US005769166A

United States Patent [19]

Duke

[11] Patent Number: 5,769,166

[45] Date of Patent: Jun. 23, 1998

[54] WELLBORE WINDOW MILLING METHOD

[75] Inventor: John A. Duke, Baytown, Tex.

[73] Assignee: Weatherford/Lamb, Inc.

[21] Appl. No.: 728,478

[22] Filed: Oct. 10, 1996

Related U.S. Application Data

[62] Division of Ser. No. 590,747, Jan. 24, 1996.

[51] Int. Cl.[6] ..... E21B 29/06; E21B 7/06

[52] U.S. Cl. ..... 166/298; 175/61

[58] Field of Search ..... 166/117.6, 117.5, 166/298, 50; 175/61, 79–82

[56] References Cited

U.S. PATENT DOCUMENTS

| | | | |
|---|---|---|---|
| 1,570,518 | 1/1926 | Mitchell | 166/117.6 |
| 1,589,399 | 6/1926 | Kinzbach . | |
| 1,795,553 | 3/1931 | Getty . | |
| 1,804,819 | 5/1931 | Spencer, Jr. et al. | 166/117.6 |
| 1,812,880 | 7/1931 | Kinzbach et al. | 166/117.6 |
| 1,816,856 | 8/1931 | Kinzbach et al. | 255/11 |

(List continued on next page.)

FOREIGN PATENT DOCUMENTS

PCT/EP/93/02504 9/1992 WIPO .

OTHER PUBLICATIONS

"Kinzbach Tool Co., Inc. Catalog 1958–59," Kinzbach Tool Company, Inc., 1958; see pp. 3–5 paraticularly.

"Dual horizontal extension drilled using retrievable whipstock," Cress et al, Worked Oil, Jun. 1993, five pages.

"Casing Whipstocks," Eastman Whipstock, Composite Catalog, p. 2226, 1976–77.

"Bowen Whipstocks," Bowen Oil Tools, Composite Catalog, one page, 1962–63.

"Improved Casing Sidetrack Procedure Now Cuts Wider, Larger Windows," Cagle et al, Petroleum Engineer International, Mar. 1979.

"Weatherford Fishing and Rental tool Services," 1993.

A–1 Bit & Tool company 1990–01 General Catalog, pp. 8, 14.

Frank's, "The Submudline Drivepipe Whipstock, Patent #4,733,732".

Int's Search Report, PCT/EP94/02589, counterpart of this application S.N. 08/210,697.

Int'l Search Report 2nd, PCT/EP94/02589, counterpart of this application S.N. 08/210,697.

TIW SS–WS Whipstock Packer Information, Texas Iron Works, 1987.

Offers For Sale, 1991, Triumph–LOR, Inc.

"Horizontal Slim–Hole Drilling With coiled Tubing: An Operator's Experience," Ramos, et al, Society of Petroleum Engineers, 1992.

"Slim–Hole and Coiled–Tubing Window Cutting Systems," Faure et al, Society of Petroleum Engineers, 1993.

"Oilfield Services and Manufactured Products Catalog," Homco Int'l Ltd., 1990.

"Mills General–Export Price Catalog," Servco Co., 1972.

*Primary Examiner*—Hoang C. Dang
*Attorney, Agent, or Firm*—Guy McClung

[57] ABSTRACT

A wellbore milling system has been invented which includes, in one aspect, a lower window mill, and two watermelon mills connected above the window mill. In one aspect the topmost of the two watermelon mills has a plurality of cutting blades with rough dressed outer surfaces and the lowermost watermelon mill has such blades with smooth outer surfaces. Such a system may be used in a multi-trip method with a starter mill first run into a wellbore to start a window to be milled by the window-watermelon-mills combination.

16 Claims, 18 Drawing Sheets

U.S. PATENT DOCUMENTS

| | | | |
|---|---|---|---|
| 1,835,227 | 12/1931 | Lane et al. . | |
| 1,866,087 | 7/1932 | Crowell . | |
| 1,869,759 | 8/1932 | Lynch . | |
| 2,014,805 | 9/1935 | Kinderliter . | |
| 2,065,896 | 12/1936 | Keever . | |
| 2,101,185 | 12/1937 | Monroe . | |
| 2,102,055 | 12/1937 | Brauer . | |
| 2,103,622 | 12/1937 | Kinzbach . | |
| 2,105,721 | 1/1938 | Carter et al. . | |
| 2,105,722 | 1/1938 | Barrett et al. | 175/81 |
| 2,132,061 | 10/1938 | Walker | 166/117.6 |
| 2,170,284 | 8/1939 | Eastman | 166/117.6 |
| 2,207,920 | 7/1940 | Hughes | 175/81 |
| 2,227,347 | 12/1940 | Johnson | 175/82 X |
| 2,298,706 | 10/1942 | Kothny . | |
| 2,324,682 | 7/1943 | DeLong | 166/117.6 |
| 2,331,293 | 10/1943 | Ballard | 166/117.5 |
| 2,338,788 | 1/1944 | Walker . | |
| 2,445,100 | 7/1948 | Wright | 166/117.6 |
| 2,495,439 | 1/1950 | Brinble | 175/81 |
| 2,509,144 | 5/1950 | Grable et al. . | |
| 2,567,507 | 9/1951 | Brown | 166/117.5 |
| 2,586,878 | 2/1952 | Staton . | |
| 2,633,331 | 3/1953 | Hampton | 255/1.6 |
| 2,633,682 | 4/1953 | Jackson . | |
| 2,638,320 | 5/1953 | Condra . | |
| 2,664,162 | 12/1953 | Howard et al. | 116/117.5 |
| 2,699,920 | 1/1955 | Zublin | 166/117.6 |
| 2,770,444 | 11/1956 | Neal | 166/117.6 |
| 2,797,893 | 7/1957 | McCune et al. | 175/79 |
| 2,807,440 | 9/1957 | Beck | 255/1.6 |
| 2,882,015 | 4/1959 | Beck . | |
| 2,885,182 | 5/1959 | Hering | 255/1.6 |
| 2,950,900 | 8/1960 | Wynes | 175/61 |
| 2,999,541 | 9/1961 | Kinzbach et al. . | |
| 3,000,440 | 9/1961 | Malcomb | 166/4 |
| 3,059,708 | 10/1962 | Cannon et al. . | |
| 3,075,583 | 1/1963 | Nielsen | 166/117.5 |
| 3,095,039 | 6/1963 | Kinzbach | 166/117.6 |
| 3,096,824 | 7/1963 | Brown | 166/210 |
| 3,106,973 | 10/1963 | Christensen . | |
| 3,116,799 | 1/1964 | Lemons | 175/61 |
| 3,118,511 | 1/1964 | Kay . | |
| 3,145,790 | 8/1964 | Bridwell et al. . | |
| 3,172,488 | 3/1965 | Roxstrom | 175/81 |
| 3,667,252 | 6/1972 | Nelson | 64/23.5 |
| 3,713,194 | 1/1973 | Danly | 29/103 A |
| 3,908,759 | 9/1975 | Cagle et al. | 166/117.6 |
| 4,007,797 | 2/1977 | Jeter | 175/26 |
| 4,153,109 | 5/1979 | Szescila | 166/250 |
| 4,266,621 | 5/1981 | Brock | 175/329 |
| 4,285,399 | 8/1981 | Holland et al. | 166/113 |
| 4,304,299 | 12/1981 | Holland et al. | 166/255 |
| 4,307,780 | 12/1981 | Curington | 166/113 |
| 4,397,360 | 8/1983 | Schmidt | 175/61 |
| 4,429,741 | 2/1984 | Hyland | 166/63 |
| 4,450,912 | 5/1984 | Callinan et al. | 166/289 |
| 4,491,178 | 1/1985 | Terrell et al. | 166/192 |
| 4,550,781 | 11/1985 | Kagler et al. | 166/340 |
| 4,646,826 | 3/1987 | Bailey et al. | 166/55.3 |
| 4,665,995 | 5/1987 | Braithwaite et al. | 175/45 |
| 4,733,732 | 3/1988 | Lynch | 175/61 X |
| 4,765,404 | 8/1988 | Bailey et al. | 166/117.6 |
| 4,796,709 | 1/1989 | Lynde et al. | 166/55.6 |
| 4,807,704 | 2/1989 | Hsu et al. | 166/313 |
| 4,844,167 | 7/1989 | Clark | 175/4.53 |
| 4,887,668 | 12/1989 | Lynde et al. | 166/55.8 |
| 4,938,291 | 7/1990 | Lynde et al. | 116/55.8 |
| 4,978,260 | 12/1990 | Lynde et al. | 166/55.6 |
| 4,984,488 | 1/1991 | Lunde et al. | 76/115 |
| 5,014,778 | 5/1991 | Lynde et al. | 166/55.6 |
| 5,035,292 | 7/1991 | Bailey et al. | 175/45 |
| 5,058,666 | 10/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,113,938 | 5/1992 | Clayton | 166/117.6 |
| 5,115,872 | 5/1992 | Brunet et al. | 175/61 |
| 5,150,755 | 9/1992 | Cassel et al. | 166/55.6 X |
| 5,154,231 | 10/1992 | Bailey et al. | 166/298 |
| 5,163,522 | 11/1992 | Eaton et al. | 175/58 |
| 5,188,190 | 2/1993 | Skaalure | 175/20 |
| 5,195,591 | 3/1993 | Blound et al. | 166/380 |
| 5,199,513 | 4/1993 | Stewart et al. | 175/73 |
| 5,211,715 | 5/1993 | Braden et al. | 175/58 |
| 5,222,554 | 6/1993 | Blount et al. | 166/117.6 |
| 5,253,710 | 10/1993 | Carter et al. | 166/298 |
| 5,265,675 | 11/1993 | Hearn et al. | 166/297 |
| 5,277,251 | 1/1994 | Blount et al. | 166/117.5 |
| 5,287,921 | 2/1994 | Blount et al. | 166/117.6 |
| 5,287,922 | 2/1994 | Bridges | 166/277 |
| 5,297,630 | 3/1994 | Lynde et al. | 166/297 |
| 5,318,121 | 6/1994 | Brockman | 166/313 |
| 5,318,122 | 6/1994 | Murray et al. | 166/313 |
| 5,322,127 | 6/1994 | McNair et al. | 166/313 |
| 5,335,737 | 8/1994 | Baugh | 175/61 |
| 5,341,873 | 8/1994 | Carter et al. | 166/117.5 |
| 5,346,017 | 9/1994 | Blount et al. | 166/380 |
| 5,373,900 | 12/1994 | Lynde et al. | 166/297 |
| 5,379,845 | 1/1995 | Blount et al. | 166/382 |
| 5,423,387 | 6/1995 | Lynde | 175/61 |
| 5,445,222 | 8/1995 | Pritchard et al. | 116/298 |
| 5,456,312 | 10/1995 | Lynde et al. | 166/55.6 |
| 5,474,126 | 12/1995 | Lynde et al. | 166/17.6 |
| 5,484,017 | 1/1996 | Coon | 166/116.5 |
| 5,553,671 | 9/1996 | Sieber | 166/381 |
| 5,584,350 | 12/1996 | Schnitker et al. | 165/61 |
| 5,592,991 | 1/1997 | Lembcke et al. | 166/117.6 X |
| 5,595,247 | 1/1997 | Braddick | 166/297 |
| 5,657,820 | 8/1997 | Bailey et al. | 166/55.7 |

2B
2B
5
4
7
9
10
8
2
3
1
6

4
10
8
7
9
4
5

S
R
L
N
V

P
C
M
T

WELLBORE WINDOW MILLING METHOD

RELATED APPLICATIONS

This is a division of U.S. application Ser. No. 08/590,747 filed on Jan. 24, 1996 entitled "Wellbore Milling Guide".

BACKGROUND OF THE INVENTION

1. Field of the Invention

This invention is directed to milling tubulars in a wellbore and, in one aspect, to methods for guiding a mill in a wellbore and apparatus useful in such methods.

2. Description of Related Art

An opening or a window is formed in a tubular, e.g. casing, in a wellbore with a milling tool with a mill, that has metal cutting structure on its surface. Typically the tool is threadably attached to a section of drill pipe or other heavy tubular components comprising a bottom hole assembly that is in a well to cut a window through the side of a piece of casing. In certain methods the milling tool is assisted in generating a window by a device known as a whipstock, a wedge shaped object, anchored in the casing wellbore which serves to support the milling tool and forcibly direct it outward through the side of the casing, facilitating formation of the window.

In certain methods a whipstock is not utilized, and the ability of the milling tool to generate the window without the wedge shape forcing it through the casing is severely inhibited and often practically impossible. This is primarily due to the face that, without the whipstock, the only force avoidable to urge the mill sideways into the casing is the inherent stiffness of the milling tool and associated drill pipe transversing a curve in the casing (see FIG. 1). In many cases, side loading on the milling tool is not sufficient to initiate and maintain cutting action.

In some cases a whipstock utilized in a downhole application for generating a window in casing is susceptible to damage from the aggressive cutting surface of a mill and, if not protected, is inadvertently damaged or cut away.

There has long been a need for an efficient and effective milling guide and method of its use. There has long been a need for a method for milling a window in a tubular at a desired location without the use of a whipstock. There has long been a need for a milling method which does not result in damage to a whipstock.

SUMMARY OF THE PRESENT INVENTION

The present invention, in one embodiment, discloses a method for milling a tubular of a string of tubulars in a wellbore, e.g. a piece of casing in a cased wellbore, the method including: installing a mill guide in a tubular at a desired location at which a window is to be milled out of the tubular; inserting a milling tool through the tubular string and through the mill guide; guiding the milling tool; and milling the window through the tubular. In one aspect the mill guide has a generally cylindrical hollow body with an end opening disposable at the desired location in the tubular and sized, shaped and configured so that the milling apparatus simultaneously contacts the tubular on one side and the interior of the mill guide on the other side; thus the mill guide supports the mill on one side and directs the milling tool against the tubular on an opposing side. A mill guide according to this invention may also be used in drilling to direct a drill against a tubular and-or to direct a drill into a formation through which a wellbore extends.

The mill guide is anchored in a tubular to be milled with any suitable anchor apparatus, including but not limited to packers or movable members of slips with teeth to engage the tubular's interior. The mill guide can be installed using a tubular string, wireline, or coiled tubing.

In certain embodiments it is desired to form a window at a curved area of a tubular. The lower end of the mill guide, in certain embodiments, is shaped to conform and correspond to the shape (e.g., curved, slanred, non-straight, etc.) of the tubular to be milled. In certain aspects, the lower end of the mill guide does not contact a tubular in which it is disposed and in other aspects it contacts and rests against an interior of a casing sectionor other tubular for added support . In other embodiments the mill guide's lower end is curved or slanted to conform to and correspond to the shape of the concave or wedge-shaped portion of a whipstock. In methods employing such a mill guide, the mill guide is disposed adjacent the whipstock and, in one aspect, in contact with its concave or wedge-shaped portion. In such a method the whipstock can provide support for the mill guide and enhance the mill guide's ability to direct the mill to the tubular to be milled.

In another aspect a mill guide according to the present invention is secured in a tubular above ground and this tubular is introduced into a wellbore and moved to a desired location therein. In one aspect the mill guide is formed integrally of a such a tubular.

To provide support for a mill of a milling tool used with a mill guide according to this invention, in certain embodiments the drill pipe, other tubulars, or centralizing apparatus connected to the milling tool are sized and disposed so that after milling is completed and surfaces of the mill have exited the mill guide, the drill pipe, etc. to contacts the mill guide's interior surface. Thus the mill continues to be supported by and directed by the mill guide. After milling is completed, the milling tool is removed from the well base and, if desired, the mill guide is retrieved from the wellbore. In one aspect, the mill guide and milling apparatus are retrieved together and-or as a unit.

It is, therefore, an object of at least certain preferred embodiments of the present invention to provide:

New, useful, unique, efficient, nonobvious wellbore milling methods for guiding a milling tool to mill a hole, slot, or window in a tubular in a wellbore;

Such a method useful with or without a whipstock;

Such a method in which a milling tool guided by a mill guide continues to be directed to a tubular to be milled after milling surfaces of the milling tool have exited the mill guide;

Such a method in which a whipstock's concave member is protected by a mill guide during milling; and Apparatus useful in such methods, including a mill guide with a hollow body and a lower opening configured to facilitate milling at a desired location by directing a mill against a tubular to be milled.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figures 1A, 1B, 2A, 2B:
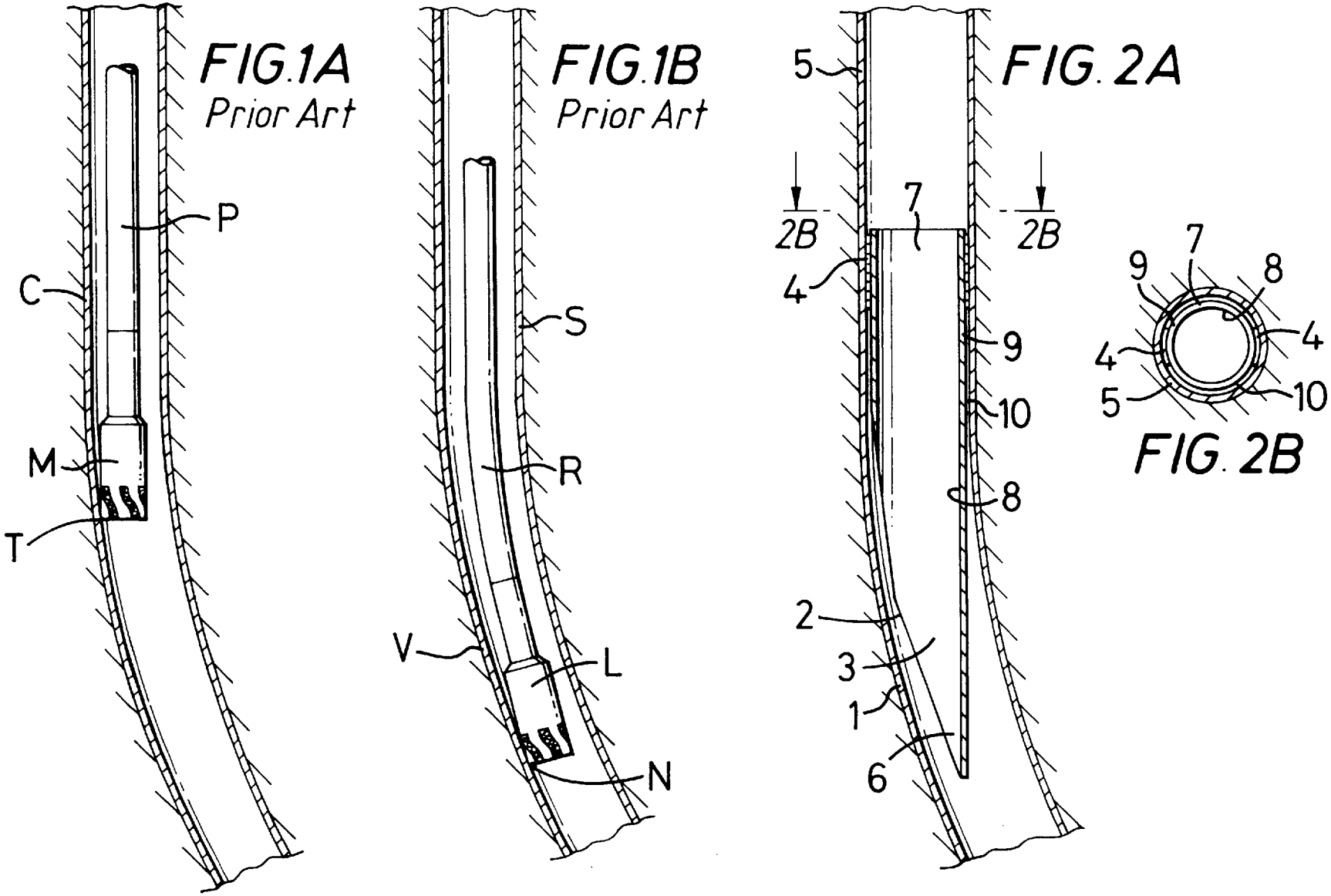
FIG. 1B Prior Art
FIG. 1A Prior Art
FIG. 1A is a schematic side view, partially in cross-section, of a prior art system with a mill inside a casing to be milled.
FIG. 1B is a schematic side view, partially in cross-section, of a prior art system with a mill inside a casing to be milled.
FIG. 2A is a side view in cross-section of a mill guide according to the present invention anchored in a wellbore casing.
FIG. 2B is a top end cross-sectional view of the mill guide and casing of FIG. 2A.

FIG. 1A shows a prior art mill M attached to drill pipe P in a casing C. When the mill M contacts the interior of the casing C at a point T, the mill M tends to be deflected away from the point T. The stiffness of the drill pipe P (and other drill pipe and items in a string above and connected to the drill pipe P, not shown) is, in most cases, insufficient to prevent the mill M from deflecting away from the interior of the casing C.

FIG. 1B shows a prior art mill L attached to a drill pipe R in a casing S with a curved portion V. When the mill L contacts the interior of the casing S at a point N of the curved portion V, the mill L is deflected away from the point N.

FIGS. 2A and 2B show a mill guide 10 according to the present invention with a hollow cylindrical body 9 having a bore 8 therethrough, an open top end 7 and an open bottom end 6. The mill guide 10 is disposed in a piece of casing 5 which is part of a string of casing (not shown) in a wellbore in the earth. An anchor 4 (or anchors) holds the mill guide 10 in place at a desired location in the casing with an opening 3 of the mill guide's bottom end 6 disposed and oriented so that a mill passing through the mill guide 10 will mill a desired area of the casing, creating a desired hole, slot, opening, or window. The bottom end 6 of the mill guide 10 is formed or cut to have a desired shape 2. This shape 2 may be made to correspond to a curved portion 1 of the casing 5.

Figure 3:
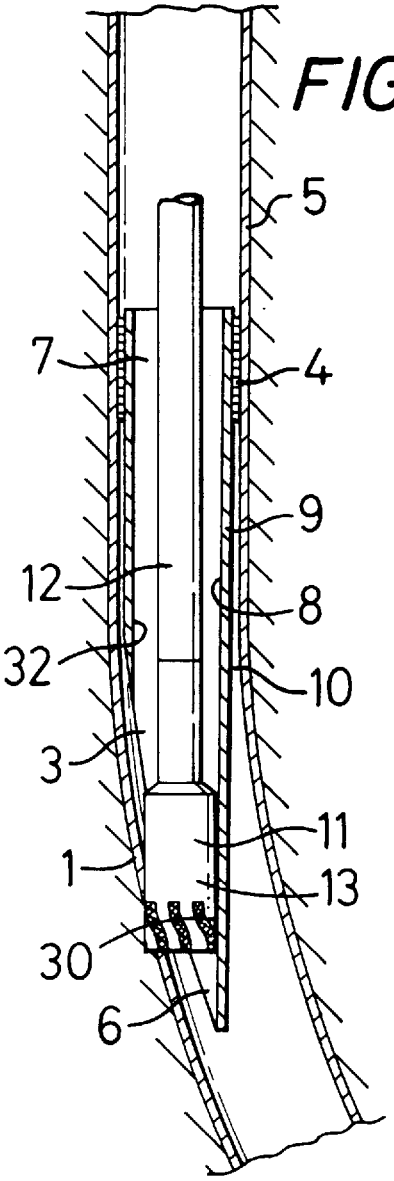
FIG. 3 is a side view of the system of FIG. 2A including a milling apparatus.

As shown in FIG. 3, a mill 11 on a string of drill pipe 12 has been introduced through the casing 5 and the mill guide 10 to contact the casing 5 and begin to mill a hole therethrough. A body 13 of the mill 11 has a length such that at least about a fourth of the desired opening is milled (and in other aspects substantially all of the desired opening) while the mill body 13 remains in contact with a side 30 of the bottom end 6 of the mill guide 10, thus providing a continuous reaction support during part or substantailly all of the milling. The side 30 may be the same thickness as a side 32 which is shorter than the side 30; or the side 30 may be thicker than the side 32. The interior of the side 30 may one or more additional layers of material thereon. Such material may also inhibit the mill from milling the side 30. This additional material may be any desired practical thickness and may be any known suitable material, including, but not limited to, steel, carbide steel, stainless steel, known alloys, and hardfacing material. Such a layer or layers may be added by any known method (e.g., welding or hardfacing) or may be formed integrally of the side 30.

Figure 4:
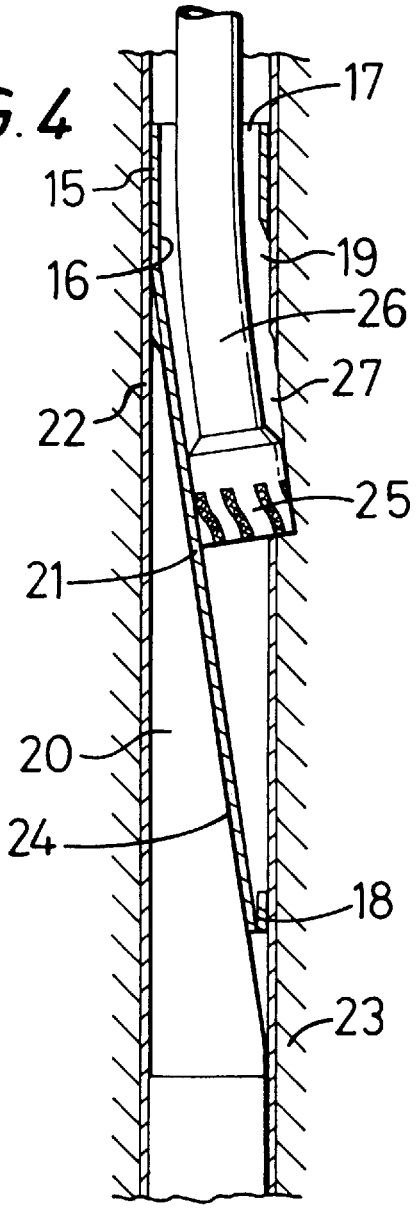
FIG. 4 is a side view, partially in cross-section of a system according to the present invention.

FIG. 4 shows a mill guide 15 with a hollow body 16, a top open end 17, a bottom end point 18, a side opening 19, and a slanted side member 21. A whipstock 20 disposed in a casing 22 in a wellbore 23 has a concave surface 24 which corresponds to the shape of the slanted side member 21. The mill guide 15 is made of a strong metal, e.g. steel, so that the slanted side member 21 protects the concave surface 24 from the effects of a mill 25 on flexible pipe 26. The whipstock 20 and the side opening 19 are positioned so that a window 27 is cut at a desired location on the casing 22. As shown in FIG. 4 the window 27 has only been partially milled and will be completed as the mill 25 moves down the slanted side member 21. It is within the scope of this invention for the mill guide 15 and the whipstock 20 to be connected together; to be formed integrally as one member; or for the mill guide 15 to be releasably connected to the whipstock (e.g. but not limited to, by one or more shear studs or shear lugs). In another aspect the mill guide and the whipstock are installed separately.

Figure 5:
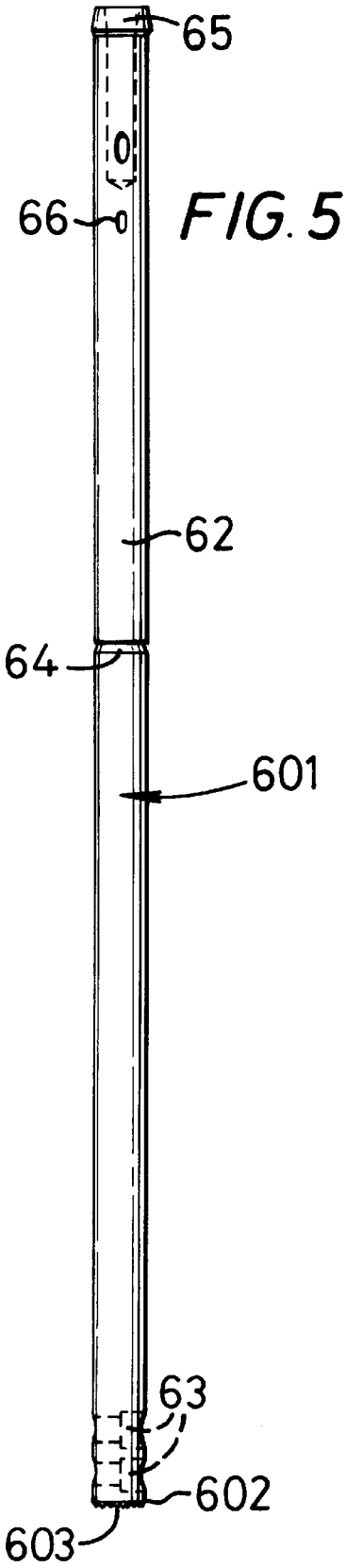
FIG. 5 is a side view of a starting bar according to the present invention.
Figure 6:
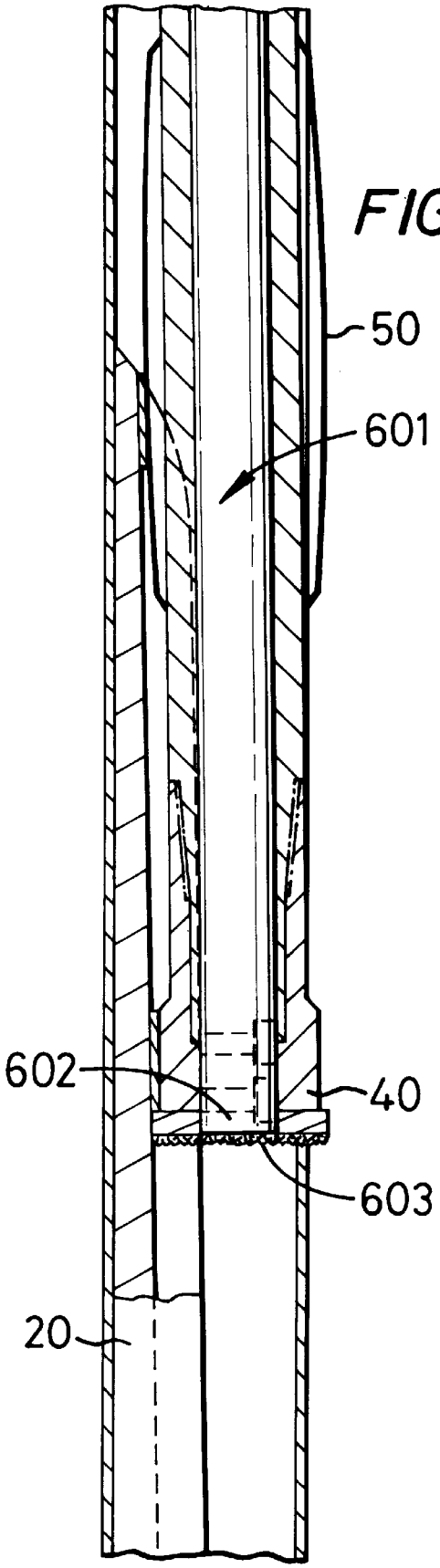
FIG. 6 is a side view in cross-section of a system according to the present invention.
Figure 7A:
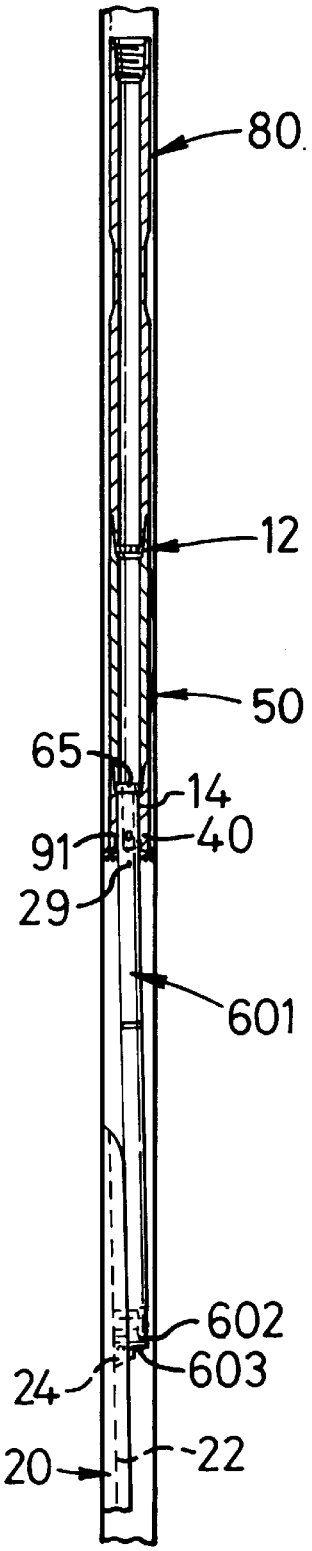
FIG. 7A is a side view partially in cross-section of a system according to the present invention.
Figure 7B:
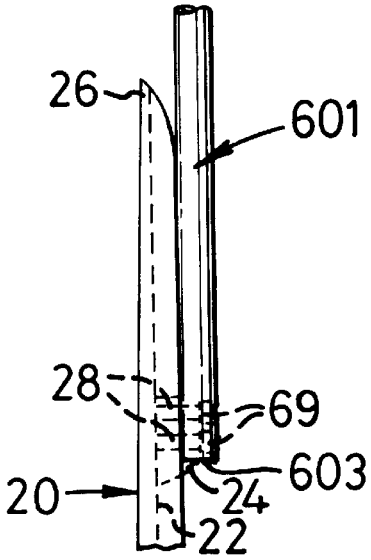
FIG. 7B is a partial view of the system of FIG. 7A.
Figure 7C:
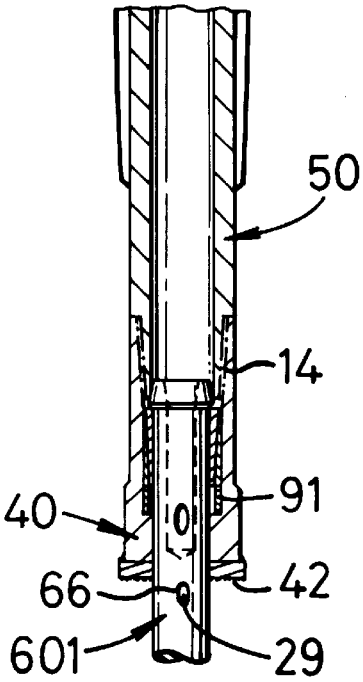
FIG. 7C is a partial view of the system of FIG. 7A.
Figure 8:
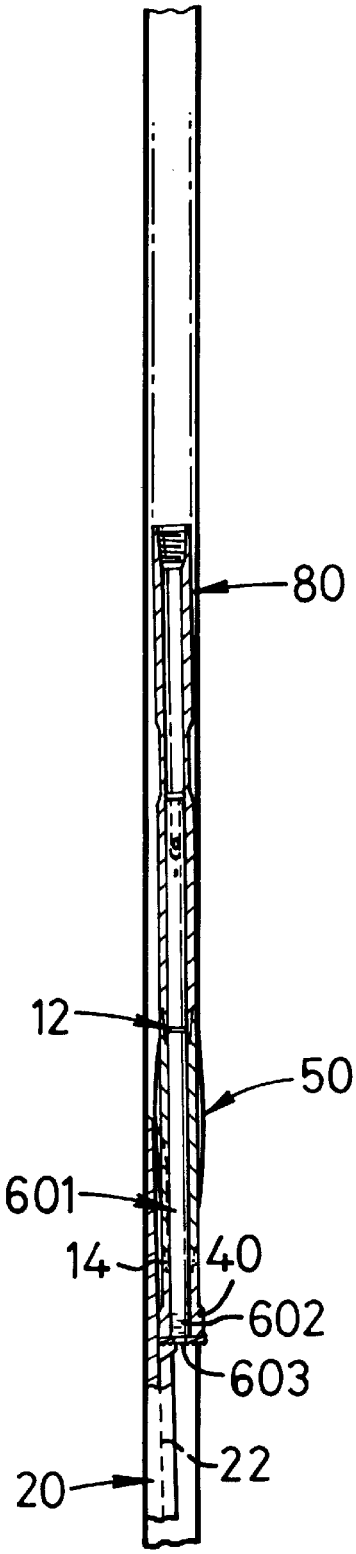
FIG. 8 is a side view partially in cross-section of the system of FIG. 7A.

The embodiments of FIGS. 5, 6, 7A, 7*b*, 7C, and 8 correspond to the embodiments of FIGS. 1C, 2B, 2A, 5, 3, and 2B respectively as shown in U.S. Pat. No. 5,429,187, with like numerals indicating like structure. FIG. 5 illustrates a starting bar 601 which is like the starting bar 60, previously described, but which has a solid milling end 602 which is dressed with any known milling inserts and-or milling material or matrix 603. As shown in FIG. 6, upon receipt of the starting bar 601 within the starting mill 40, the solid milling end 602 is disposed so that the milling material 603 is flush with milling material on the lower end of the starting mill 40. In this position the starting bar 601 is, in certain embodiments, held in place within the starting mill 40 and prevented from rotating and from falling therefrom by any suitable holding mechanism.

Figure 9:
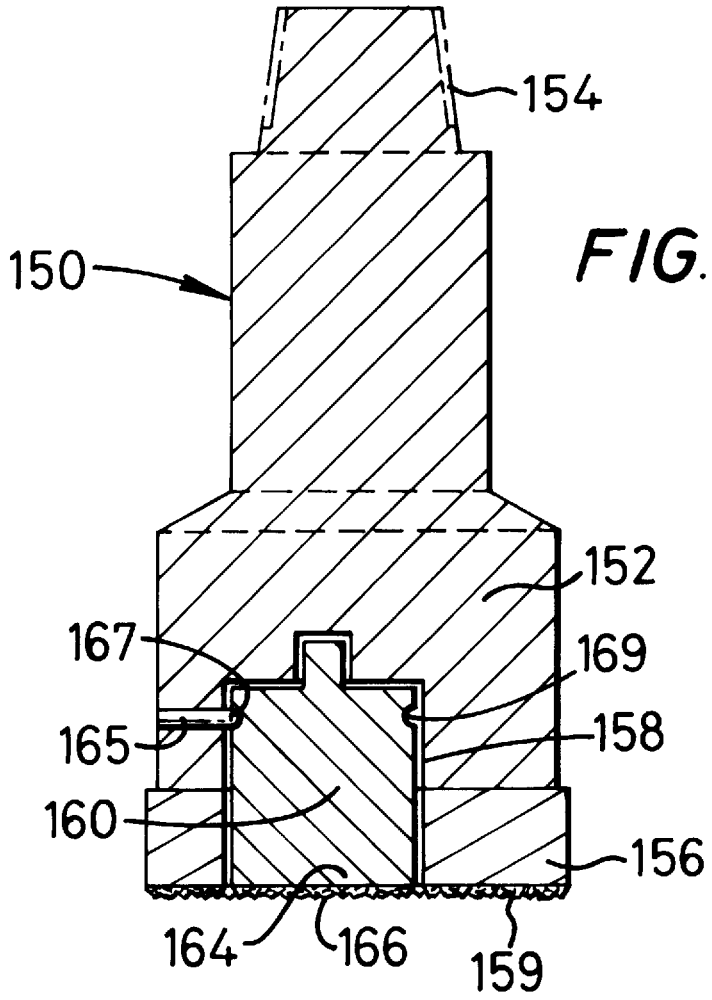
FIG. 9 is a side cross-sectional view of a mill according to the present invention.
Figure 10:
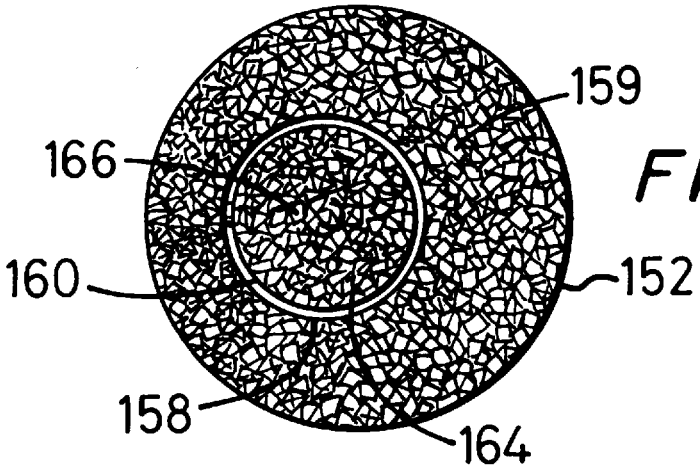
FIG. 10 is a bottom end view of the mill of FIG. 9.
Figure 11A:
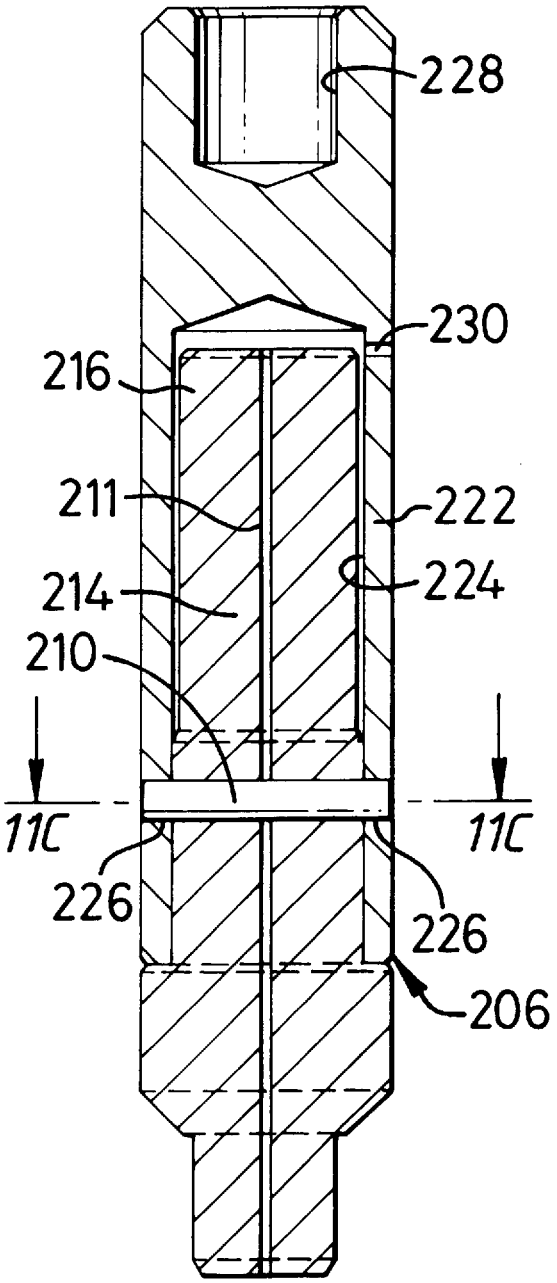
FIG. 11A is a side cross-sectional view of a connection apparatus according to the present invention.
Figure 11B:
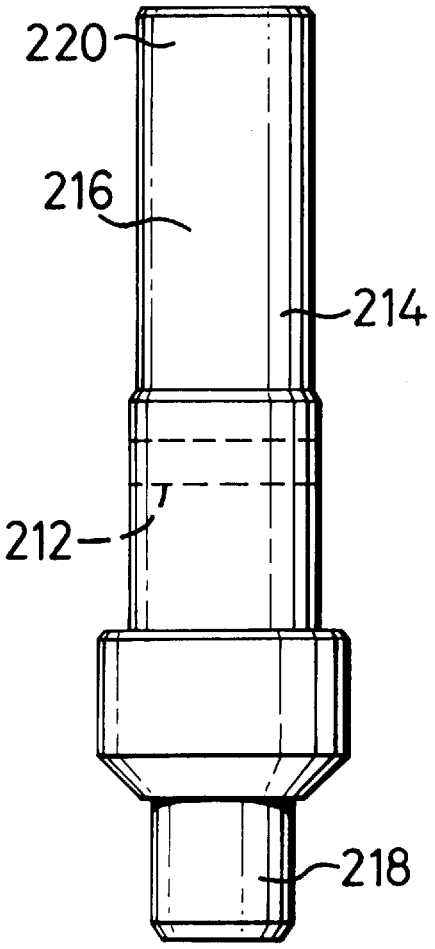
FIG. 11B is a side view of part of the apparatus of FIG. 11A.
Figure 11C:
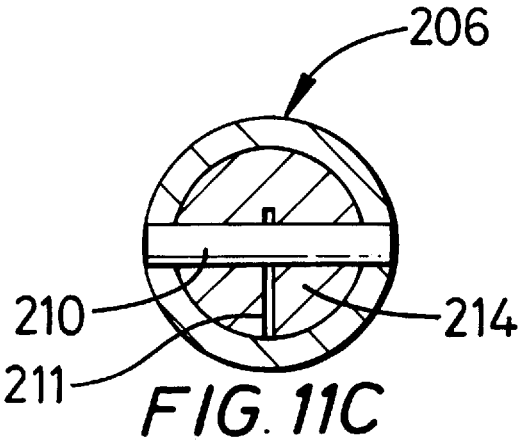
FIG. 11C is a cross-sectional view along line 11C—11C of FIG. 11A.
Figure 11D:
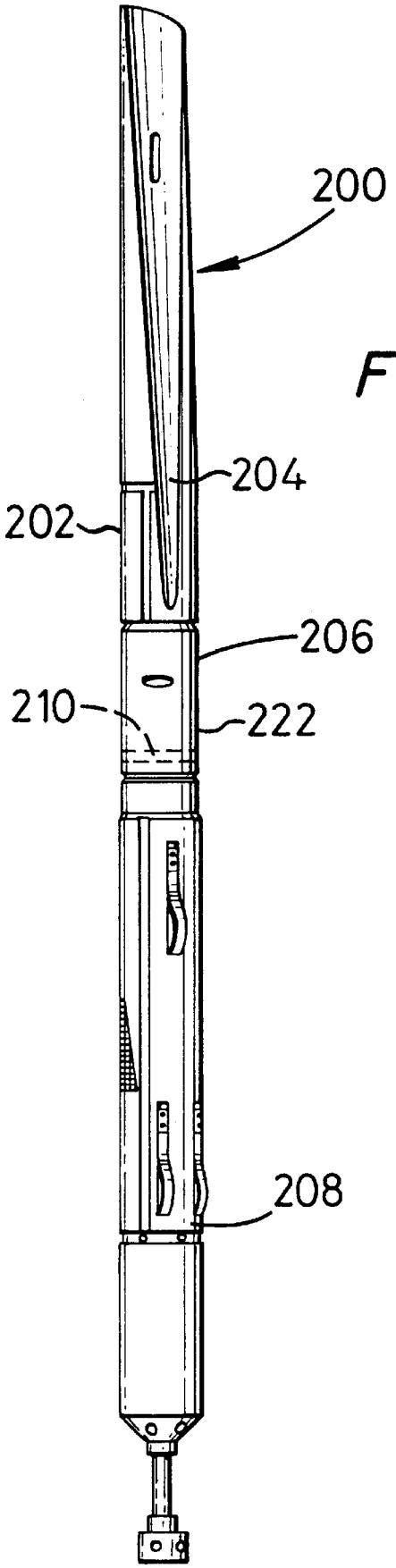
FIG. 11D is a side view of a system according to the present invention with the connection apparatus of FIG. 11A.

FIG. 9 and 10 illustrate a mill 150 according to the present invention with a mill body 152, an upper threaded end 154, a lower milling end 156, a recess 158, and milling inserts and-or milling matrix material 159. An inner milling member 160 is rotatably disposed in the recess 158. The inner milling member 160 has a lower end 164 dressed with milling inserts and-or milling material 166. It is within the scope of this invention for the mill 150 to be a window mill or any other mill on which an inner mill is useful. The recess 158 and, therefore, the inner milling member 160 may be located anywhere on the lower milling end 156, including, but not limited to, in the center of the lower milling end 156 or, as shown in FIGS. 9 and 10, off-center. A pin 165 whose end 167 rides in a recess 169 holds the inner milling member 160 in the mill body 152.

FIGS. 11A–11D illustrate a whipstock system 200 according to the present invention with a whipstock 202 having a concave face 204, connection apparatus 206 for releasably connecting the whipstock 202 to an anchor apparatus 208. The anchor apparatus may be any known anchor device or anchor-packer. As shown, the anchor apparatus 208 is like that disclosed in U.S. Pat. No. 5,341,873, co-owned with the present invention.

The connection apparatus 206 has a shear pin 210 which is designed and configured to shear under a desired force, e.g. 95000 pounds. The shear pin 210 extends through a hole 212 in a neck 214 of a fishing member 216. A relief channel 211 provides fluid relief. A lower end 218 of the fishing member 216 is connected to the anchor apparatus 208 e.g. by welding. An upper end 220 of the fishing member 216, once exposed, provides a member which can be speared or grappled by fishing equipment to facilitate removal of the anchor apparatus 208 from a casing or wellbore once the whipstock 202 has been separated from the anchor apparatus 208 by shearing the shear pin 210 and removing the whipstock 202. This eliminates the need for milling away the whipstock 202 and eliminates problems encountered in such milling when a mill, instead of milling the whipstock, is forced away from the whipstock by the concave face 204. A hole 230 provides fluid relief.

An end 222 of the whipstock 202 has a recess 224 which receives and holds the neck 214 of the fishing member 216. The shear pin 210 extends into holes 226 in the end 222 of the whipstock 202. A recess 228 receives a portion of an end of a part of the whipstock which is welded in place.

Figure 12A:
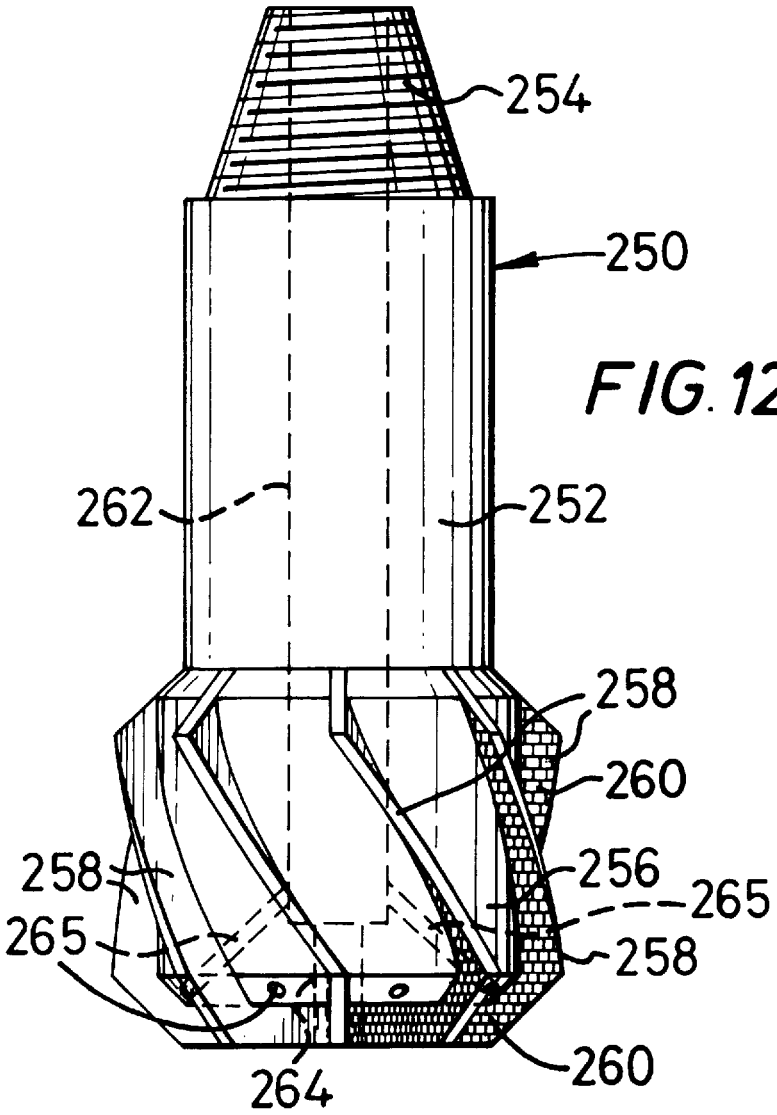
FIG. 12A is a side view of a mill according to the present invention.
Figure 12B:
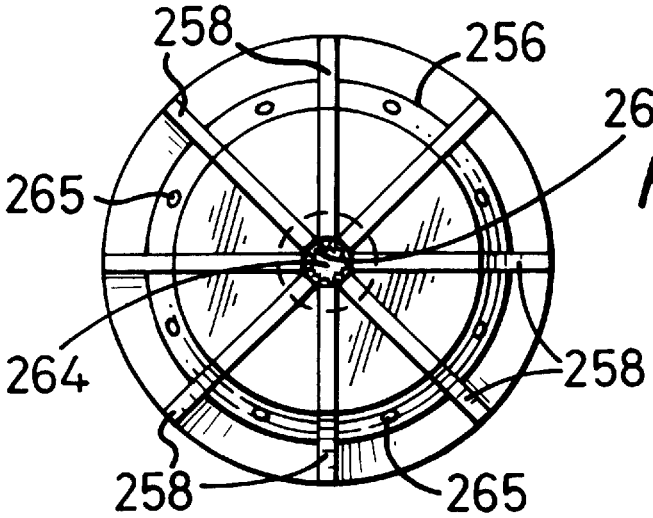
FIG. 12B is an end view of the mill of FIG. 12A.

FIG. 12A shows a window mill 250 according to the present invention. The mill 250 has a body 252, an upper threaded end 254, a lower milling end 256, a plurality of milling blades 258 with milling inserts 260 and-or desired matrix milling material secured thereto, and an inner fluid flow bore 262 with a lower narrow bore 264. Milling material and-or inserts 263 may be used on the surface of the bore 264. Fluid flowing through the narrow bore 264 flows faster than fluid flowing in the bore 262. Fluid jets 265 direct fluid under pressure out past the blades, preferably with one jet per blade, to inhibit the nesting of cuttings and to facilitate fluid circulation and the upward removal of cuttings.

Figure 13:
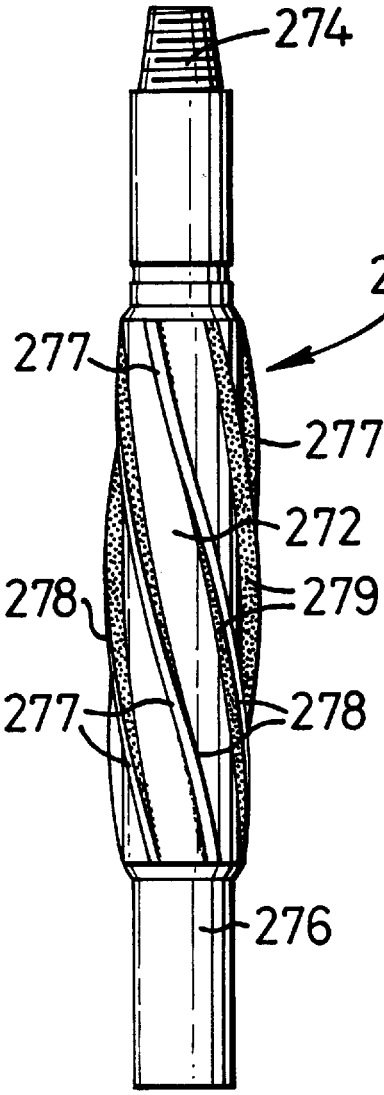
FIG.13 Prior Art
FIG. 13 is a side view of a prior art watermelon mill.

FIG. 13 shows a prior art watermelon mill 270 with a body 272, an upper threaded end 274, a lower end 276 and a plurality of blades 278 covered with milling inserts and-or matrix milling material 279. Outer surfaces 277 of the blades 278 are ground down to a smooth finish.

Figure 14:
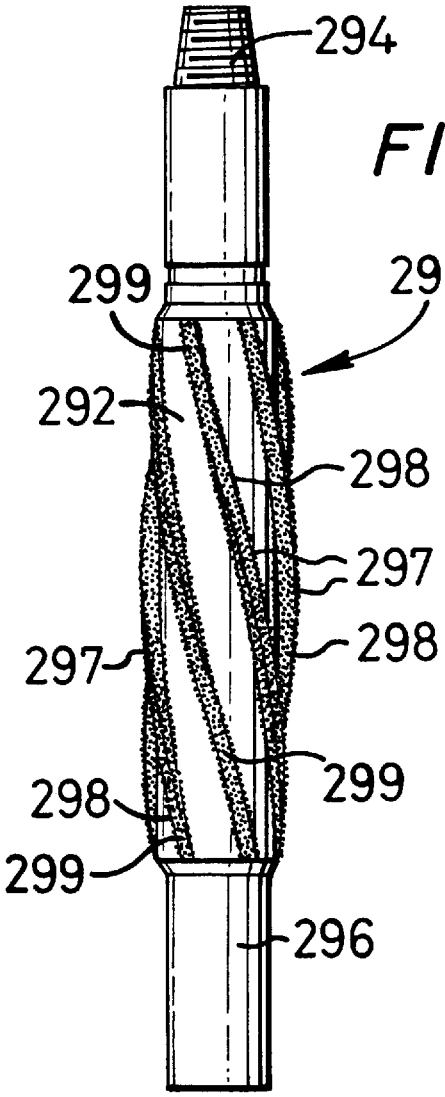
FIG. 14 is a side view of a prior art watermelon mill.

FIG. 14 shows a mill 290 like the mill 270, but with rough outer surface 297 on its blades 298; i.e., the outer surfaces 297 are covered with milling material 299 which is not ground smooth. The mill 290 has a body 292, an upper threaded end 294 and a lower end 296, but to inventor's knowledge no such mill has been used in the prior art to mill an opening in or window through a tubular such as casing until the outer surfaces 297 have been first ground smooth.

Figure 15A:
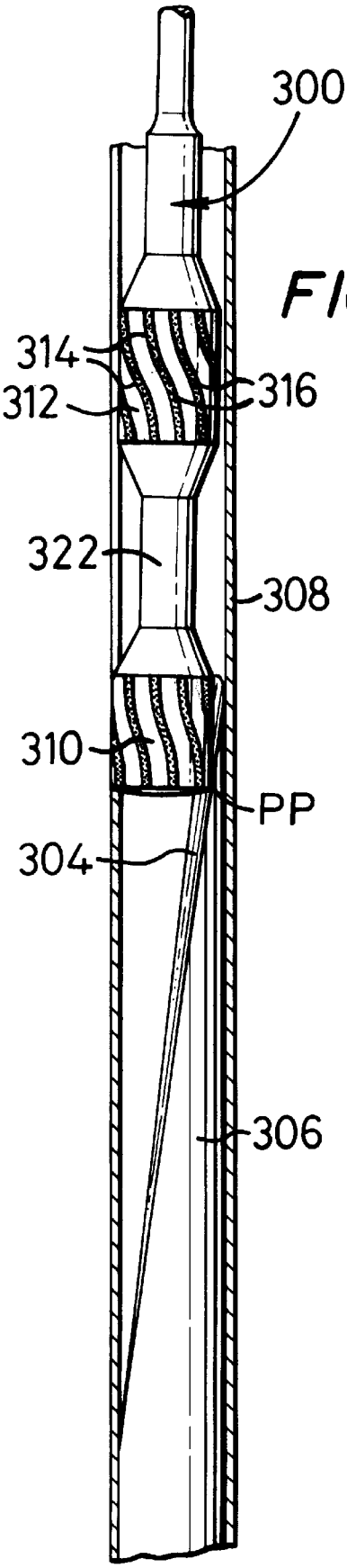
FIG. 15A is a side view of a system useful in a method according to the present invention.

FIG. 15A shows a milling system 300 contacting a concave 304 of a whipstock 306 in a casing 308. The milling system 300 has a starter or window mill 310 and a watermelon mill 312. The window mill may be any window mill available in the prior art or disclosed herein. In one aspect the window mill has a smooth finish lateral outer surface. The watermelon mill preferably has blades 314 with rough outer surfaces 316. One or more pieces of drill pipe or one or more drill collars are connected above the watermelon mill 312. For flexibility, a single joint of drill pipe is used in the string above the water melon mill. As shown in FIG. 15A, a casing pivot point O is created during milling about which the watermelon mill and associated neck 322 are pivoted into the casing (to the left on FIG. 20A).

Figure 16:
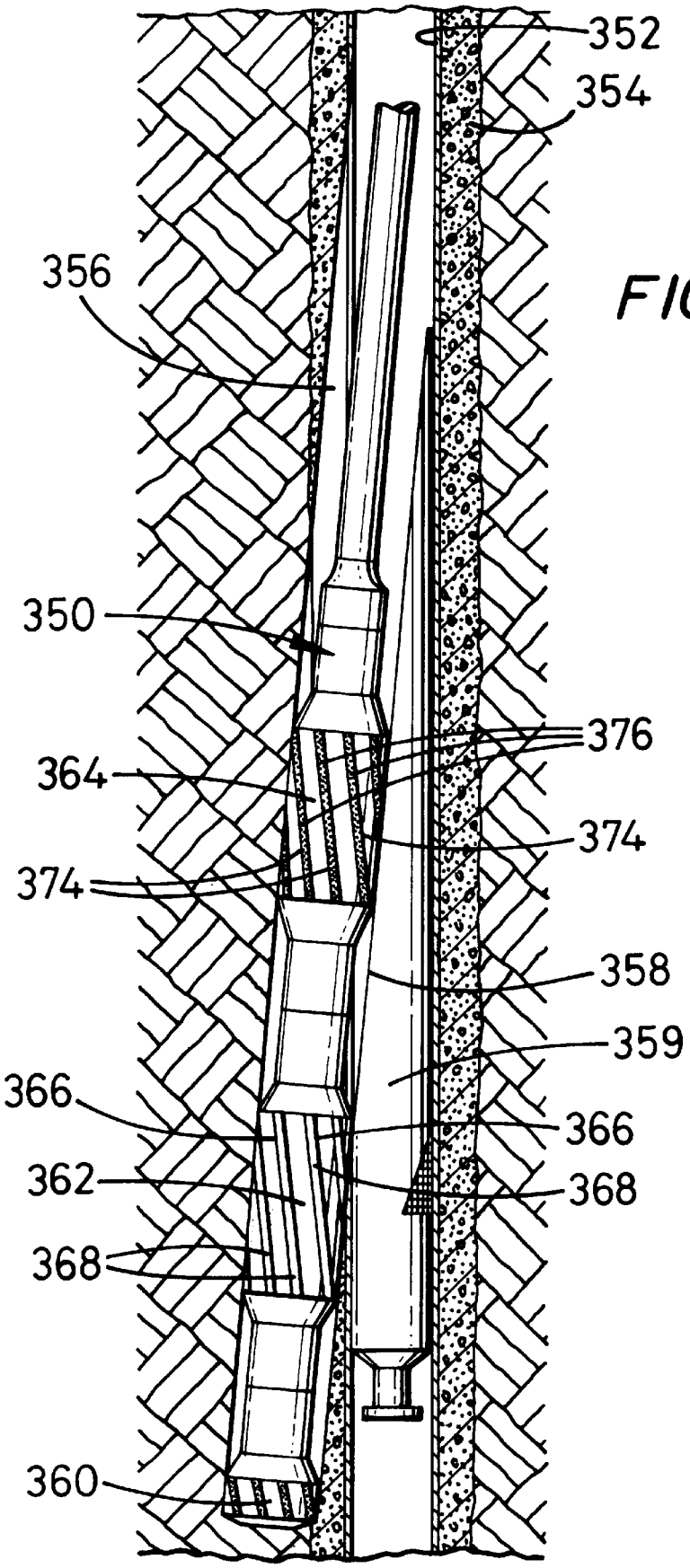
FIG. 16 is a side view of a system useful in a method according to the present invention.
Figure 17A:
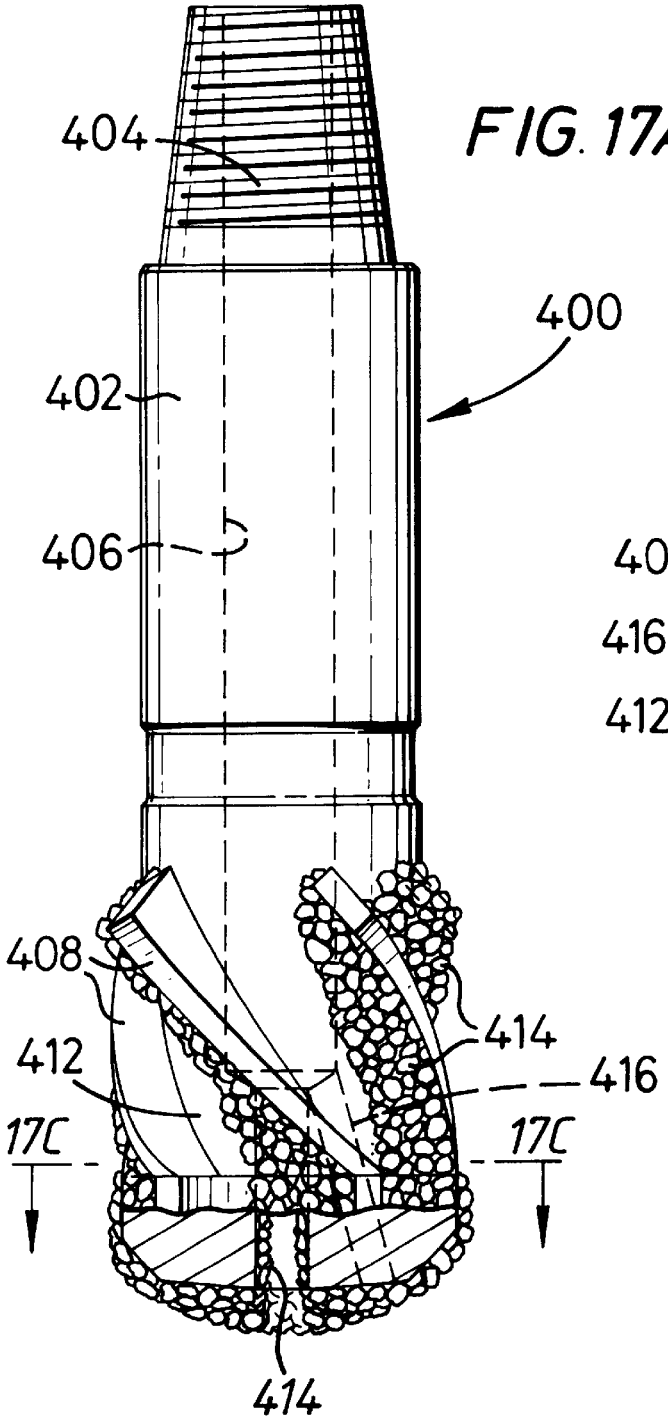
FIG. 17A is a side view, partially in cross-section, of a mill according to the present invention.
Figure 17C:
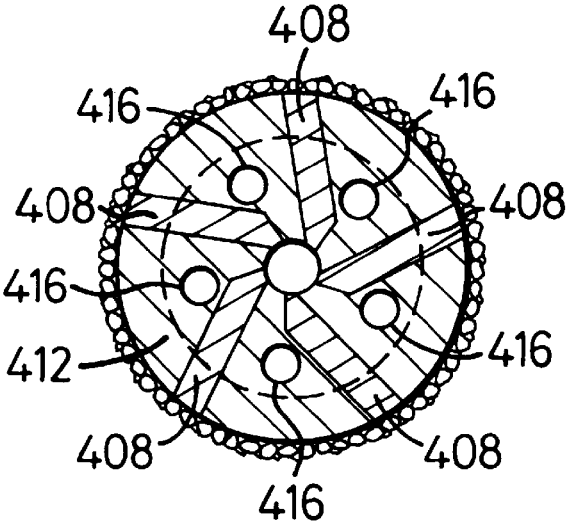
FIG. 17C is a cross-sectional view along line 17C—17C of FIG. 17A.
Figure 17B:
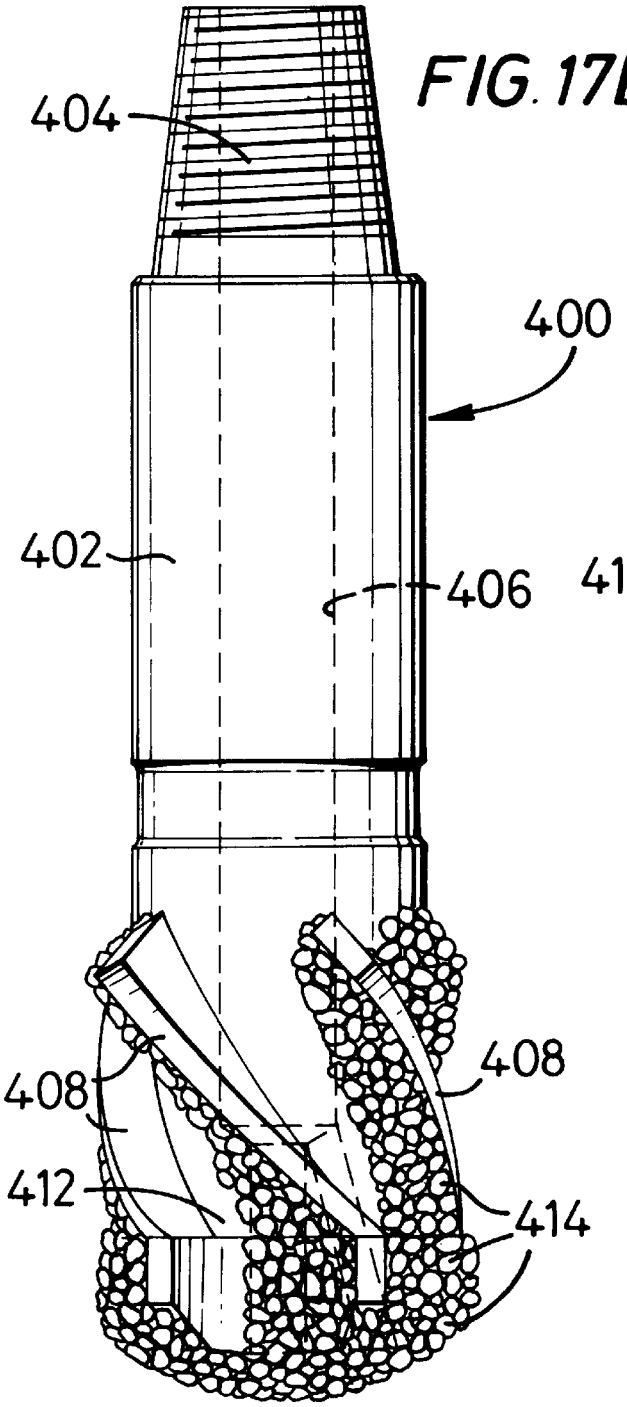
FIG. 17B is a side view of the mill of FIG. 17A.
Figure 17D:
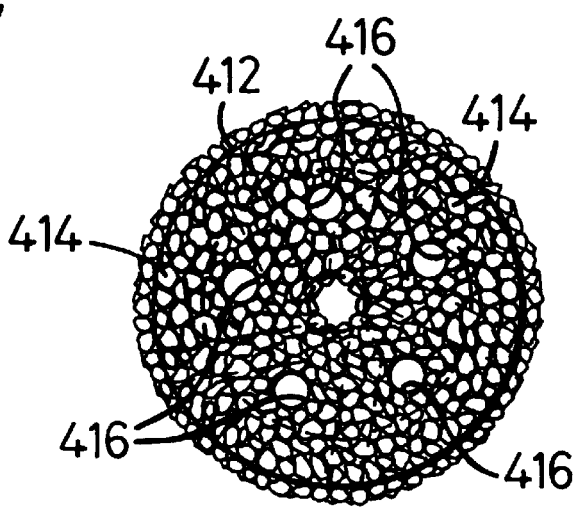
FIG. 17D is an end view of the mill of FIG. 17A.

FIG. 16 shows a milling system 350 in a casing 352 in a wellbore, 354. The system 350 has a window mill 360, a first watermelon mill 362, and a second watermelon mill 364. The mills may be any conventional prior art mills or any mill disclosed herein. The second watermelon mill 364, in certain embodiments, has blades 374 with rough dressed outer surfaces 376. The first watermelon mill 362, in certain embodiments, has blades 366 with smooth outer surfaces 368. The milling system 350 has milled a casing window 356 and has moved down on a concave 358 of a whipstock system 359 (like that of U.S. Pat. No. 5,341,873 or FIG. 11D) anchored in the wellbore 354.

Figure 15B:
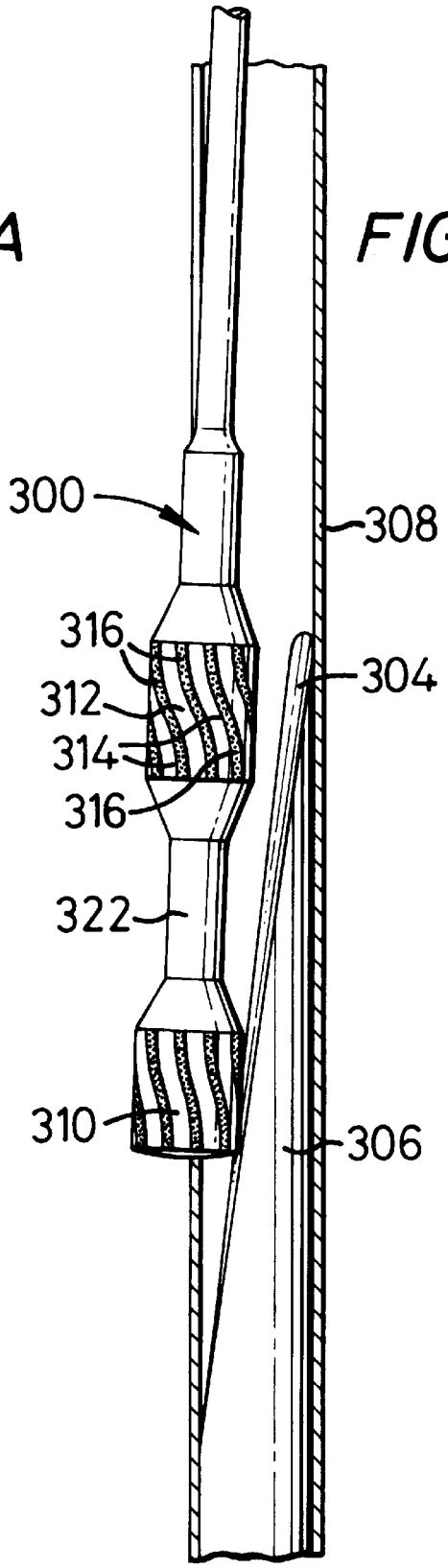
FIG. 15B is a side view of another step of the method of FIG. 15A.

In one method according to the present invention, a whipstock system with a starter mill releasably secured thereto is run into casing in a wellbore. The whipstock system is oriented as desired and anchored in place. The starter mill is released from the whipstock and rotated to mill off a lug on the whipstock's concave to which the starter mill was shear pinned. Preferably the starter mill starts a window and mills off the lug, but does not mill the concave. The starter mill is then removed from the casing and a milling system like the system 300 is run into the casing. The watermelon mill 312 has blades 314 which are rough dressed with known matrix milling materials 316. The mill 310 is sized, configured, and positioned as is the neck 322 and the watermelon mill 312 is spaced apart from the window mill 310 so that the watermelon mill 312 does not mill the whipstock 306 or its concave 304 (see FIG. 15B). Both the starter mill 310 and the watermelon mill 312 mill out a window 320 from the casing 308. In one aspect a neck 322 of about eighteen to twenty inches separates the window mill 310 and the watermelon mill 312 (e.g., in one aspect, for milling a window about 12 to 15 feet long in a tubular; e.g. casing ranging in outer diameter from 2⅞" to 16" or larger). Any lip created by the window mill 310 on the casing 308 is smoothed and finished by the window mill 310 and by the watermelon mill 312. The window mill 310 may be like the mill of FIG. 12A and have blades with a smooth outer surface. Thus, in one aspect, a window about 15 feet in total length is created while using a whipstock with a concave that is about 12 feet long; i.e. a portion of the casing window is created above the whipstock. In one such method the first trip with the starter mill requires thirty minutes to four and a half hours of milling (depending in part on the weight and grade of casing) and employs a single joint of drill pipe above the starter mill; and the second trip requires about three and one-half to eight hours of milling time. With one prior art method to create such a casing window (created with a system according to this invention in about four hours of milling) about ten hours of milling or more are typically required and more than two trips are often needed. By using a window mill with a fluid flow bore, better circulation is achieved, higher pump pressure may be used, "coring" of the mill by a casing sliver or point is inhibited or eliminated, and cuttings are effectively removed. With such a system relatively less torque is needed, reducing wear and tear on various components, e.g. tubular ends.

By using a watermelon mill with blades with outer surfaces that are dressed rough with milling matrix material and/or inserts (i.e., the surfaces are not ground smooth), an elongated window is produced which reduces or eliminates the need for reaming out the window once milling ceases. In one event fishing is necessary at or below the window (e.g. to fish out a mill or other item), the elongated window facilitates fishing and allows relatively large fishing tools to be employed. Use of a rough blade outer surface watermelon mill also results in a reduced torque requirement as compared to milling with a mill with smooth blade outer surfaces ("SOD" mill). Often cuttings produced with a ROD mill are smaller than those produced with a SOD mill and it is easier to circulate the smaller cuttings up the wellbore. Also large cuttings may be inefficiently re-milled if they are not circulated upwardly.

In the situation in which a window is completed in a two-trip method, as the milling system leaves the window and starts to drill into the adjacent formation, the ROD mill smooths out any lip on the casing at the bottom of the window. Any hole in the formation made by a SOD mill which is worn and somewhat undergauge is reamed out by the ROD mill which follows the SOD mill.

If a larger casing window is desired, an additional trip may be used with the two-trip method described above. For the third trip a milling system 350 (FIG. 16) is used with a rough dressed outer blade surface window mill 360; a smooth ground outer blade surface watermelon mill 362; and a rough dressed outer blade surface watermelon mill 364. Alternatively, if it is not desired to raise the window as much as it is by using a rough top watermelon mill, the blades of the mill 362 may have outer surfaces dressed rough and the mill 364 may have blade outer surfaces ground smooth. Also, both mills may have rough-dressed blades. The window mill may be a typical prior art solid mill or a mill as in FIG. 12A. In one aspect a single drill collar is used above the top watermelon mill. In other aspects two or more drill collars are used. The watermelon mill 362 will move tightly down the face of the whipstock's concave and mill off any casing lip that may have been left by previous milling. In one situation on a third trip with an assembly including a SOD window mill, a ROD watermelon mill above it, and a SOD watermelon mill, such an assembly smooths out and elongates the top of a window created on the second trip. By using a ROD watermelon mill instead of the SOD watermelon mill the window is further enlarged and elongated, e.g. if an oversize liner is to be run through the window. By using one or more drill collars a stiffer assembly is formed which facilitates control of the formation of the top of the window and facilitates the smoothing out of rough places on the window, including any lower window lip left by a second trip. In one aspect a small portion of the bottom of the window is intentionally not milled out during a second trip. Not only does a stiffer assembly used in a third trip finish milling the window and smooth out the lower casing lip, it also better directs the milling assembly into formation adjacent the window and inhibits the tendency of the milling assembly to drift back to the annulus between the casing and the wellbore and back to the casing itself.

The previously described two-trip prior art milling method that required about ten hours of milling requires an additional eight to ten hours of milling using two smooth-surfaced blade watermelon mills and, typically, such a three-trip method requires about six days of rig time. In such a method, the window mill may "core" on the second trip, i.e., an edge of the casing attempts to bore up into the center of the mill. The window mill may jump over early on the second trip down the face of the concave and leave a ledge in the bottom of the casing window; and the casing window may not be raised high enough and a drilling assembly introduced into the casing may hang on the ledge.

A three-trip method according to the present invention, in one aspect, takes three to four days of rig time if the window mill does not "core" on the second trip (and such coring is inhibited or eliminated by using a mill with a center bottom hole, e.g. a mill as in FIG. 12A).

FIG. 17A–17D illustrates a mill 400 according to the present invention which has a body 402, an upper threaded end 404, a longitudinal fluid flow bore 406, a plurality of blades 408 (optional) on a lower end 412 of the body 402, and matrix milling material 414 on the blades 408 and lower end 412. Milling inserts may be used on the blades 408 in any known manner, combination, or pattern. Any known insert may be used, with or without chipbreaker(s), and in combination with any known matrix milling material.

The partial cross-sectional view at the lower end 412 of the mill 400 shows that the matrix milling material 414 (and milling inserts if they are also used or used in place of the matrix milling material) extends up into the lower end of the fluid flow bore 406. Such a use of matrix milling material (and-or inserts) may be used on a flow bore of any type of mill, including but not limited to a window mill, including but not limited to any mill described herein. A plurality of flow bores 416 in fluid communication with the fluid flow bore 406 provide a path for fluid discharge past the blades 408.

Figure 18A:
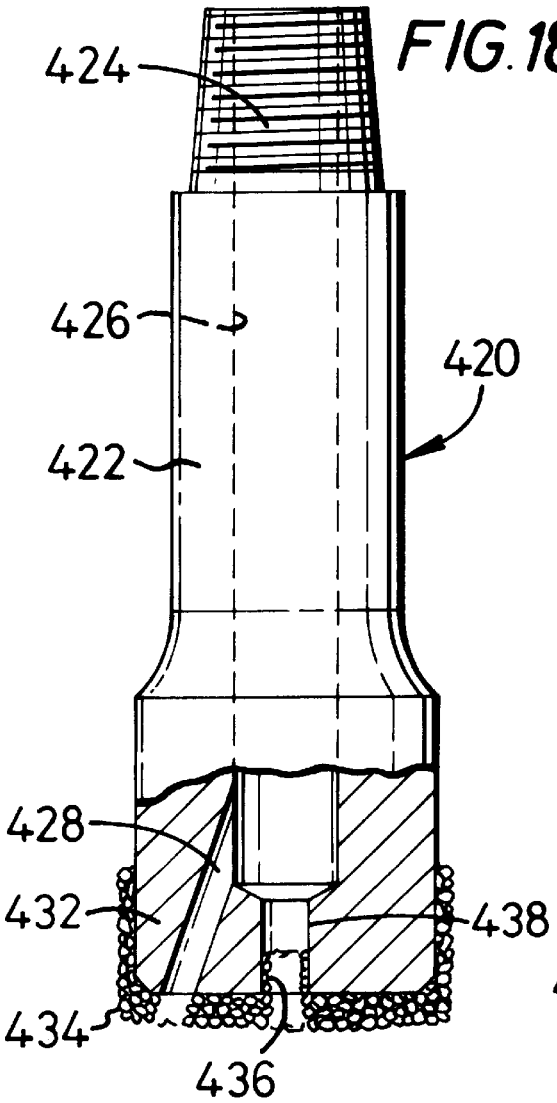
FIG. 18A is a side view, partially in cross-section, of a mill according to the present invention.
Figure 18B:
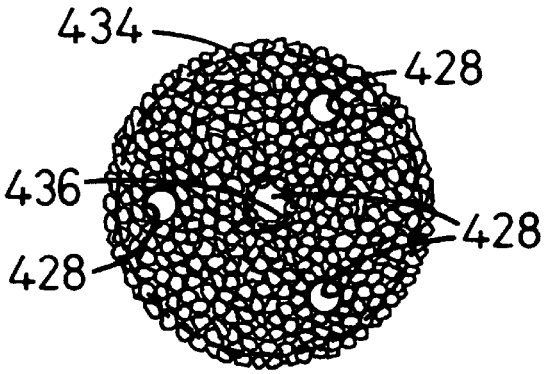
FIG. 18B is an end view of the mill of FIG. 18A.

FIGS. 18A and 18B show a mill 420 according to the present invention with a body 422, an upper threaded end 424, a longitudinal fluid flow bore 426, a plurality of sub-bores 428, a lower body end 432, and matrix milling material 434 on the lower end 432. An amount of matrix milling material 436 extends up into a lower end 438 of the longitudinal fluid flow bore 426 and, as shown in FIG. 18B, encircles the interior of the lower end 438. Milling inserts may be used in any known manner with or in place of the matrix milling material.

Figure 19A:
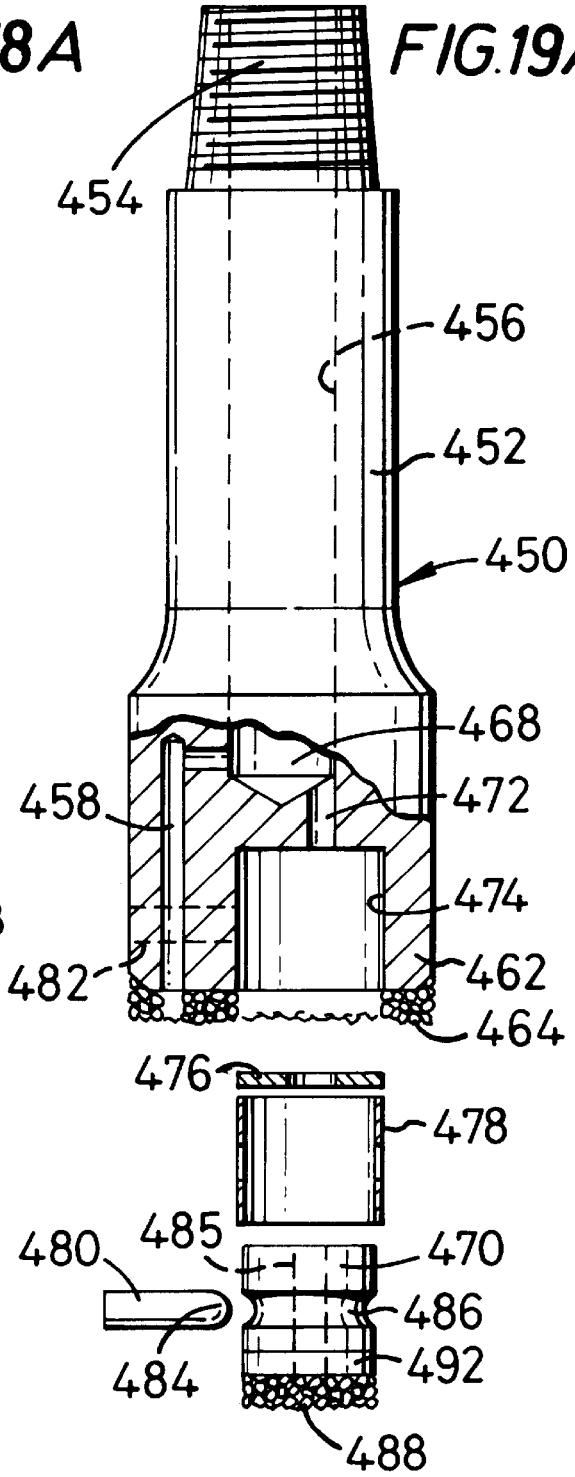
FIG. 19A is an exploded side view, partially in cross-section, of a mill according to the present invention.
Figure 19B:
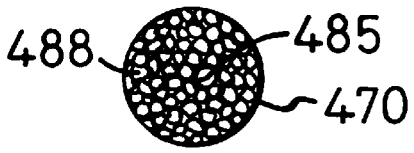
FIG. 19B is an end view of an inner mill of the mill of FIG. 19A.
Figure 19C:
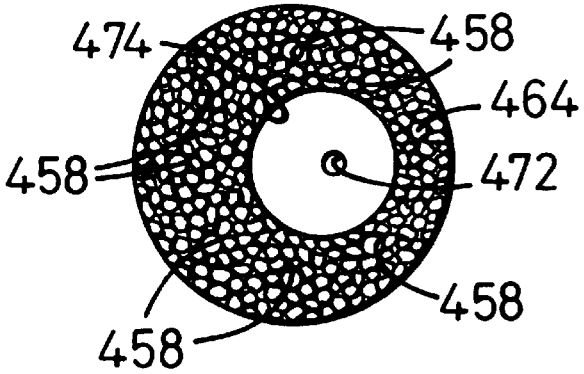
FIG. 19C is an end view of an inner mill of the mill of FIG. 19A.

FIGS. 19A–19C show a mill 450 according to the present invention with a body 452, a lower body end 462, an upper threaded end 454, a longitudinal fluid flow bore 456 with a lower end 468, a plurality of sub-bores 458, and matrix milling material 464 on the lower body end 462. A fluid sub-bore 472 is in fluid communication with the longitudinal fluid flow bore 456 and a recess 474 in which is rotatably and releasably mounted an inner mill 470 which rotates adjacent a top thrust bearing 476 and a side cylindrical bearing 478. A fluid flow bore 485 extends through the inner mill 420. A removable pin 480 extends through a hole 482 in the body 452 and has an end 484 that projects into and is releasably held in a groove 486 in the inner mill 470. Matrix milling material 488 is on a lower end 492 of the inner mill 470. Milling inserts may be used in any known manner with or in place of the matrix milling material.

Figure 20:
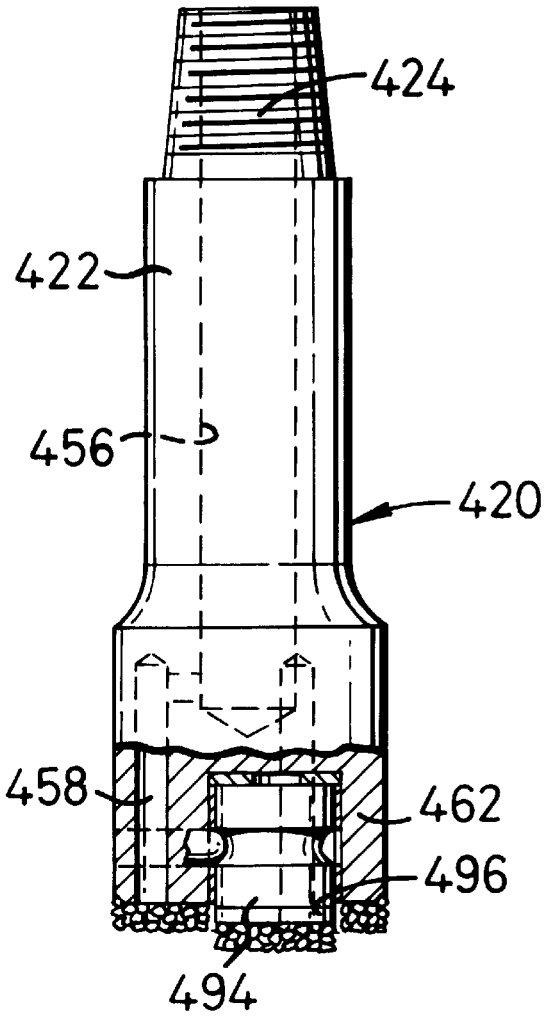
FIG. 20 is a side view, partially in cross-section, of a mill according to the present invention.
Figure 21:
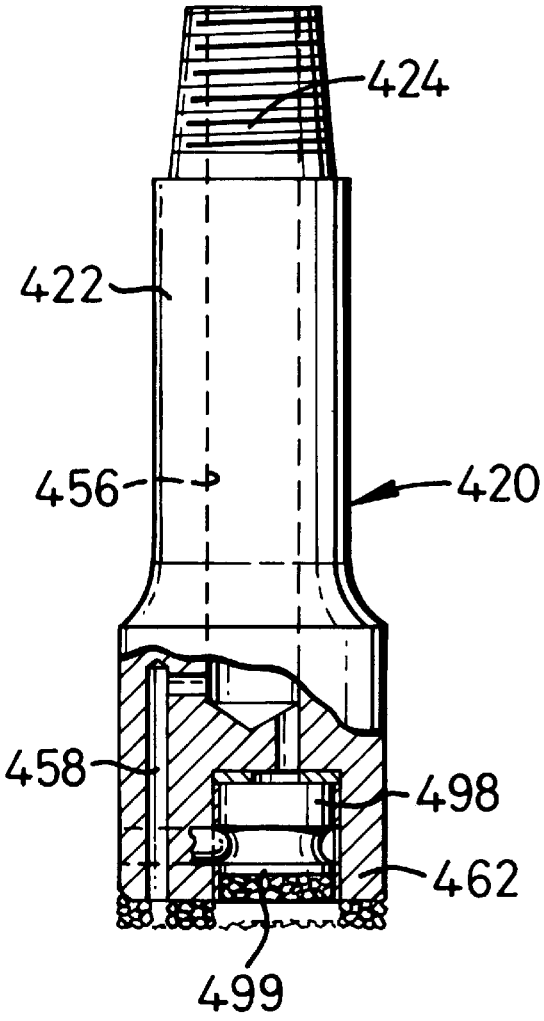
FIG. 21 is a side view, partially in cross-section, of a mill according to the present invention.

FIG. 20 and 21 show alternative embodiments of the mill 420. As shown in FIG. 21, a rotatably inner mill 494 (like the inner mill 470) may have a lower end 496 that projects downwardly beyond a lowermost surface of the lower body end 462. As shown in FIG. 26, an inner mill 498 may have a lower end 499 that does not project downwardly beyond the lower body end 462 and which is recessed upwardly away from the lowermost surface of the body end 462.

Figure 22A:
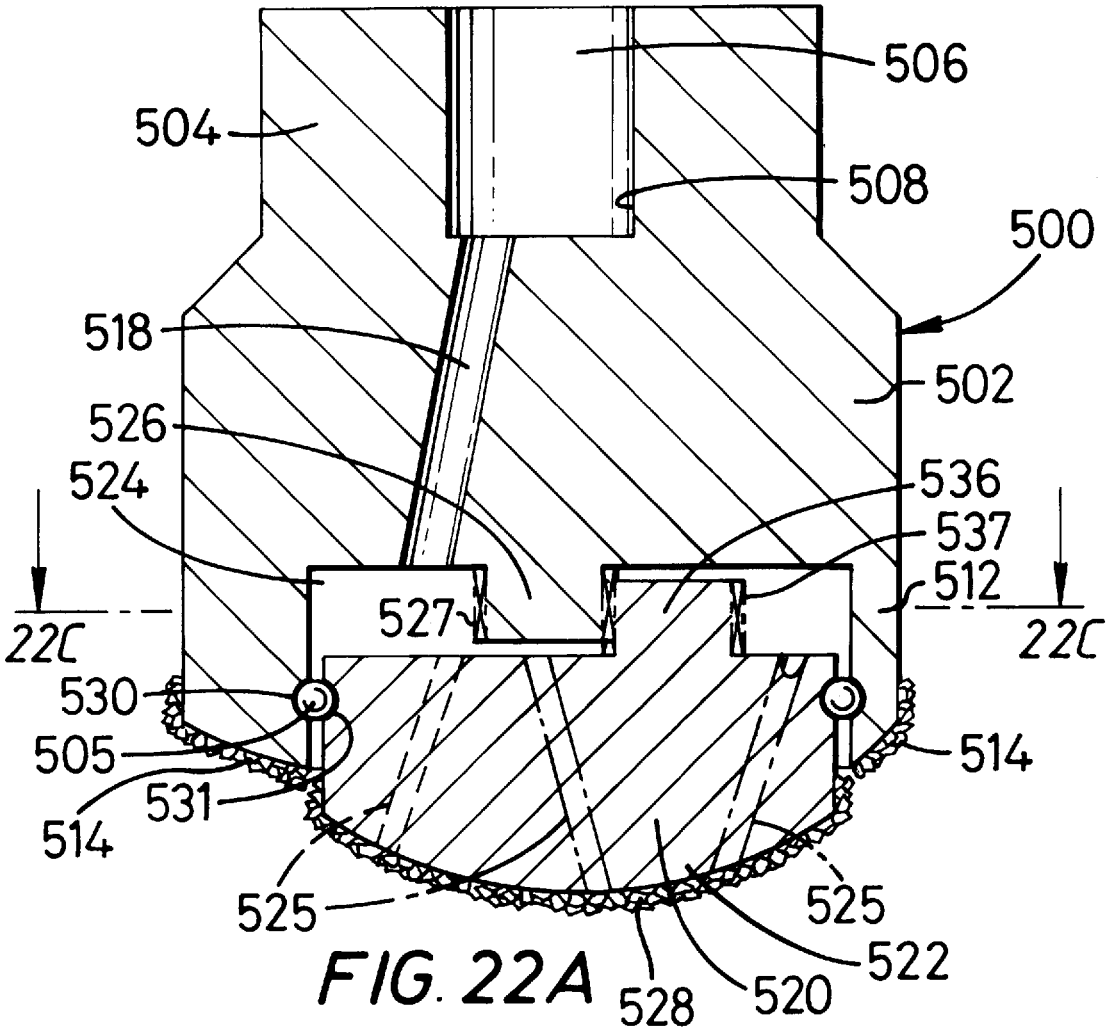
FIG. 22A is a side cross-sectional view of a mill according to the present invention.
Figure 22B:
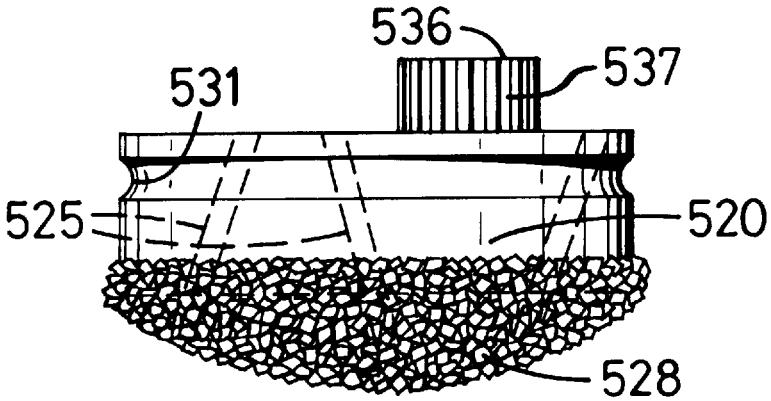
FIG. 22B is a side cross-sectional view of an inner mill of the mill of FIG. 22A.
Figure 22C:
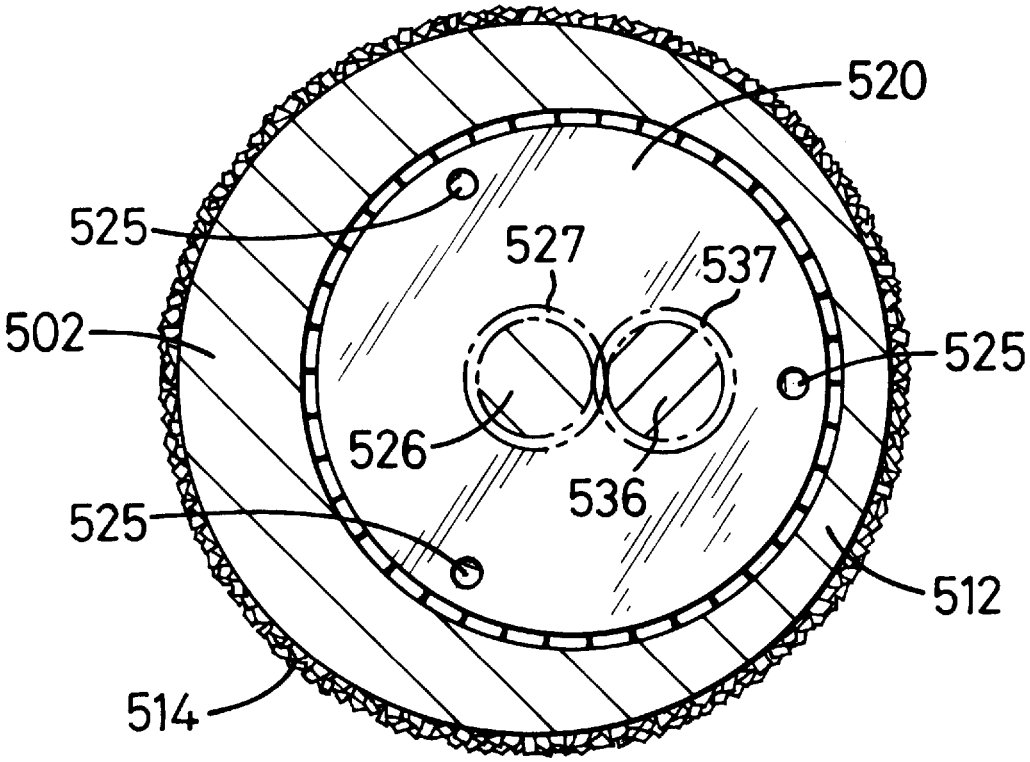
FIG. 22C is a top view of parts of the mill of FIG. 22A.
Figure 22D:
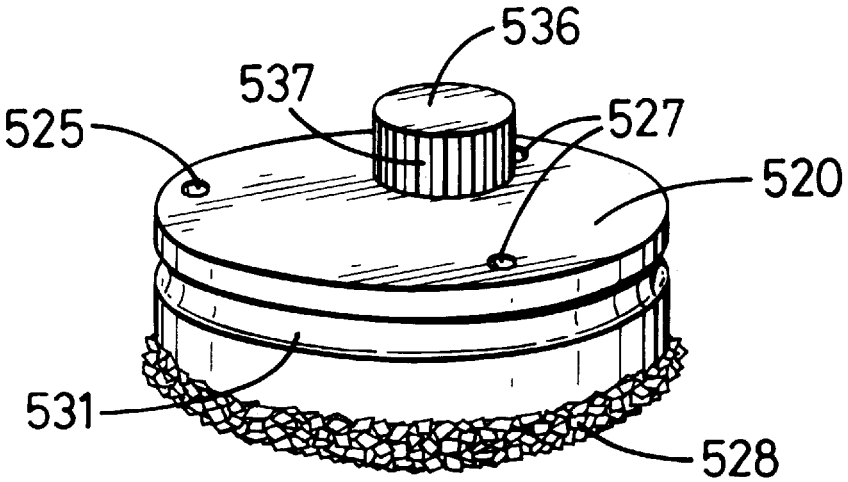
FIG. 22D is a perspective view of the mill of FIG. 22B.

FIGS. 22A–22C show a mill 500 according to the present invention with a body 502, a lower body end 512, an upper end 504, a fluid flow bore 506 with a lower end 508, a sub-bore 518, and matrix milling material 514 on the lower body end 512. The fluid sub-bore 518 is in fluid communication with the fluid flow bore 506 and a recess 524 in which is rotatably and releasably mounted an inner mill 520. Suitable bearings may be used with the inner mill 520. Fluid flow bores 525 extends through the inner mill 520. A removable pin like the pin 480 and a hole like the hole 482 and a groove like the groove 486 releasably hold the inner mill 520 in the body 502. Matrix milling material 528 is on a lower end 522 of the inner mill 520. Milling inserts may be used in any known manner or pattern with or in place of the matrix milling material. In the embodiment shown in FIG. 22A coacting recesses 530 on the body 502 and 531 on the inner mill 520 form a groove in which is movably disposed one, and preferably a plurality, of ball bearings 504 which hold the inner mill in the body 502. Such bearings may be inserted into the groove through a suitably positioned opening on the body 502 which is then closed off.

The body 502 has a gear 526 projecting downwardly with teeth 527 that mesh and coact with teeth 537 of a gear 536 that projects upwardly from the inner mill 520. Rotation of the body 502 thus imparts rotation to the inner mill 520. Any known gearing and gear ratio may be used.

For additional driving force to rotate the inner mill 520 (or for an alternative in which no gears are used), vanes or flutes are provided on the top of and/or on the sides of the inner mill 520. The force of fluid flowing through the fluid flow bore 506 and the flow bore 518 hitting the vanes or flutes turns the inner mill 520.

Figure 23A:
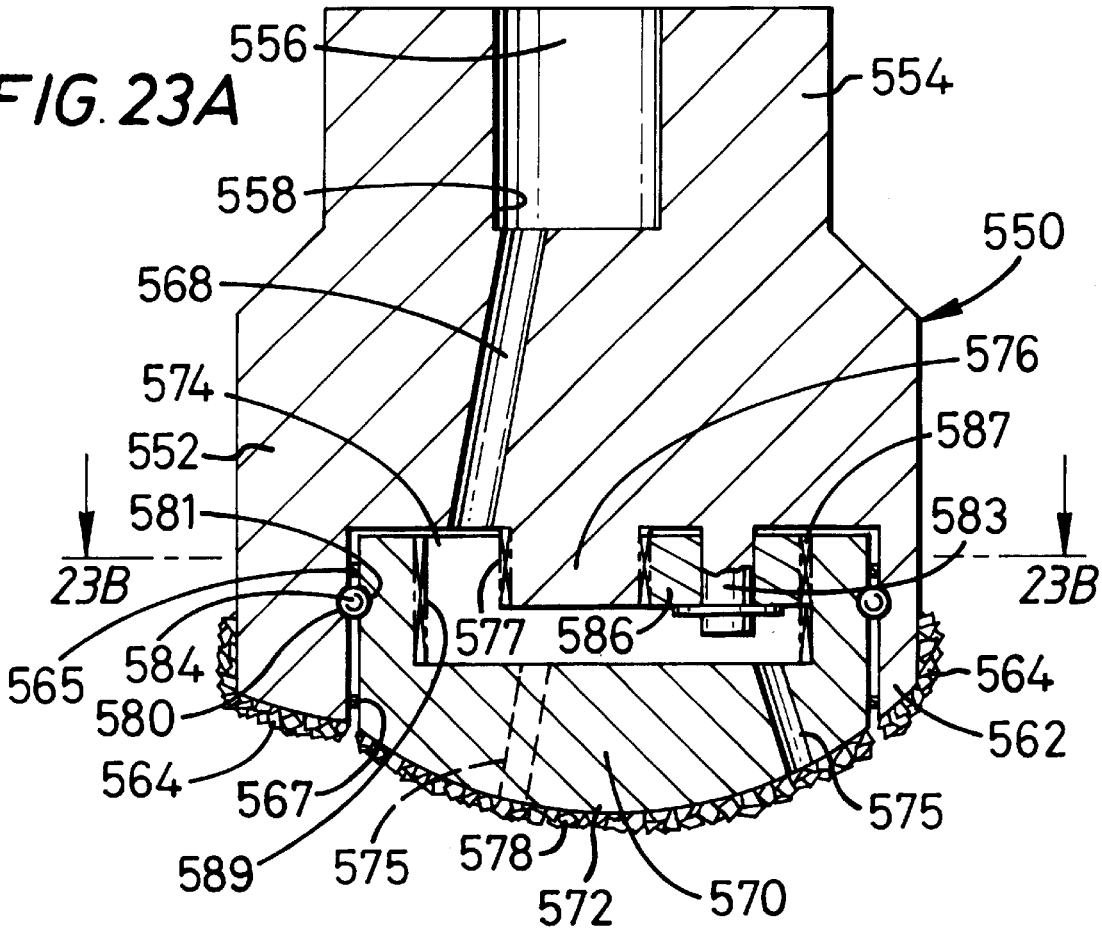
FIG. 23A is a side cross-sectional view of a mill according to the present invention.
Figure 23B:
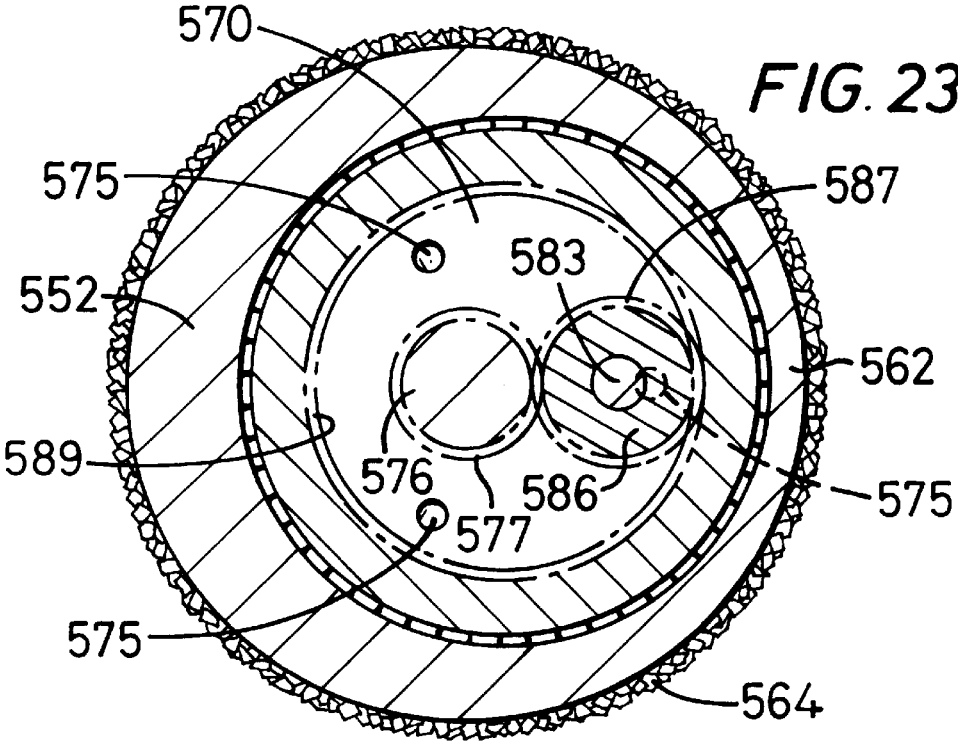
FIG. 23B is a top view of the mill of FIG. 23A.

FIGS. 23A–23B show a mill 550 according to the present invention with a body 552, a lower body end 562, an upper end 554, a fluid flow bore 556 with a lower end 558, a sub-bore 568, and matrix milling material 564 on the lower body end 562. The fluid sub-bore 568 is in fluid communication with a recess 574 in which is rotatably and releasably mounted an inner mill 570. Suitable bearings may be used with the inner mill 570. Fluid flow bores 575 extend through the inner mill 570. A removable pin like the pin 480 and a hole like the hole 482 and a groove like the groove 486 releasably may be used to hold the inner mill 570 in the body 552. Matrix milling material 578 is on a lower end 572 of the inner mill 570. Milling inserts may be used in any known manner or pattern with or in place of the matrix milling material. In the embodiment shown in FIG. 23A coacting recesses 580 on the body 552 and 581 on the inner mill 570 form a groove in which is movably disposed one, and preferably a plurality, of ball bearings 584 which hold the inner mill in the body 552. Such bearings may be inserted into the groove through a suitably positioned opening on the body 552 which is then closed off.

The body 552 has a gear 576 projecting downwardly with teeth 577 that mesh and coact with teeth 587 of a gear 586 that is rotatably mounted to the body 552 on a shaft 583. The inner mill 570 has gear teeth 589 formed on an interior surface thereof that mesh with the teeth 587. Rotation of the body 552 thus imparts rotation to the inner mill 570. Any known gearing and gear ratio may be used. Seals 565 and 567 seal the interface between the body 552 and the inner mill 570. Additional driving force (or driving force) may be provided to the mill 570 as described above for the mill 520.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A method for forming an opening in a tubular in a wellbore extending through a formation, the method comprising running a starter mill releasably secured to a whipstock into the wellbore into a tubular through which it is desired to form an opening, securing the whipstock at a desired location in the wellbore, releasing the starter mill from the whipstock, rotating the starter mill to form an initial opening in the tubular without milling the whipstock, removing the starter mill from the wellbore, introducing a milling system into the wellbore and into the tubular at the location of the initial opening, the milling system comprising a window mill, a neck member connected at its bottom to the window mill, a watermelon mill, the neck member connected at its top to the watermelon mill, the window mill having milling blades thereon with smooth finish outer surfaces, the watermelon mill having milling blades thereon with rough finish outer surfaces dressed with milling material, rotating the milling system to mill the tubular to form a completed opening therethrough, the watermelon mill and neck member sized and disposed so that the watermelon mill does not mill the whipstock, removing the milling system from the wellbore, introducing milling apparatus into the wellbore at the location of the completed window to enlarge the completed window, the milling apparatus comprising a window mill with a plurality of milling blades thereon, each blade dressed with milling material and with an outer surface rough dressed with milling material, a first watermelon mill with a plurality of milling blades thereon, each blade dressed with milling material and having an outer surface, the first watermelon mill connected to and above the window mill, a second watermelon mill connected to and above the first watermelon mill, the second watermelon mill having a plurality of milling blades each blade dressed with milling material and having an outer surface, and the method further comprising rotating the milling apparatus to elongate the completed window, and wherein the outer surfaces of the first watermelon mill's blades are smooth and the outer surfaces of the second watermelon mill's blades are rough.

2. A method for forming an opening in a tubular in a wellbore extending through a formation, the method comprising running a starter mill releasably secured to a whipstock into the wellbore into a tubular through which it is desired to form an opening, securing the whipstock at a desired location in the wellbore, releasing the starter mill from the whipstock, rotating the starter mill to form an initial opening in the tubular, removing the starter mill from the wellbore, introducing a milling system into the wellbore and into the tubular at the location of the initial opening, the milling system comprising a window mill, a neck member connected at its bottom to the window mill, a watermelon mill, the neck member connected at its top to the watermelon mill, the window mill having milling blades thereon with rough finish outer surfaces dressed with milling material, and rotating the milling system to mill the tubular to form a completed opening therethrough, the watermelon mill and neck member sized, configured, and disposed so that the watermelon mill does not mill the whipstock.

3. The method of claim 2 wherein the window mill forms an opening through the tubular with a lip and the method further comprises smoothing the lip by rotating the watermelon mill.

4. The method of claim 2 wherein the window mill comprises a body with an upper end and a lower milling end, a plurality of milling blades on the body with milling material thereon, the blades having a smooth outer surface, a first flow bore extending from the upper end through the body to a second fluid flow bore in the lower milling end, the second fluid flow bore having an inner surface, fluid jet bores extending from the first fluid flow bore to an outer side of the body for directing fluid under pressure out past the blades of the plurality of blades, and milling material on the inner surface of the second fluid flow bore.

5. The method of claim 4 wherein the second fluid flow bore is smaller in diameter than the first fluid flow bore.

6. The method of claim 2 wherein the completed window has smooth edges.

7. The method of claim 2 wherein the completed window is sufficiently long to facilitate fishing operations at or below the completed window.

8. The method of claim 2 wherein rotating the milling system produces cuttings of the tubular of sufficiently small size to facilitate circulation of the cuttings away from the completed window.

9. The method of claim 2 further comprising rotating the milling system to form a hole in the formation beyond the tubular and beyond the completed window.

10. The method of claim 9 wherein by rotating the milling system the window mill forms a hole beyond the tubular of a first diameter and the watermelon mill moves and rotates in said hole to enlarge said hole to a larger diameter.

11. The method of claim 2 further comprising removing the milling system from the wellbore, introducing milling apparatus into the wellbore at the location of the completed window to enlarge the completed window, the milling apparatus comprising a window mill with a plurality of milling blades thereon, each blade dressed with milling material and with an outer surface rough dressed with milling material, a first watermelon mill with a plurality of milling blades thereon, each blade dressed with milling material and having an outer surface, the first watermelon mill connected to and above the window mill, a second watermelon mill connected to and above the first watermelon mill, the second watermelon mill having a plurality of milling blades each blade dressed with milling material and having an outer surface, and the method further comprising rotating the milling apparatus to elongate the completed window.

12. The method of claim 11 wherein the outer surfaces of the first watermelon mill's blades are rough.

13. The method of claim 11 wherein the outer surfaces of the second watermelon mill's blades are rough.

14. The method of claim 11 wherein the outer surfaces of the first watermelon mill's blades are smooth and the outer surfaces of the second watermelon mill's blades are rough.

15. The method of claim 11 wherein at least one drill collar connected above and to the second watermelon mill forming a stiffener assembly to facilitate control

16. The method of claim 15 wherein the stiffener assembly inhibits a tendency of the milling apparatus to move back toward the casing.

* * * * *